US010472944B2

(12) United States Patent
Wassell

(10) Patent No.: US 10,472,944 B2
(45) Date of Patent: Nov. 12, 2019

(54) DRILLING SYSTEM AND ASSOCIATED SYSTEM AND METHOD FOR MONITORING, CONTROLLING, AND PREDICTING VIBRATION IN AN UNDERGROUND DRILLING OPERATION

(71) Applicant: APS Technology, Inc., Wallingford, CT (US)

(72) Inventor: Mark Ellsworth Wassell, Houston, TX (US)

(73) Assignee: APS Technology, Inc., Wallingford, CT (US)

( * ) Notice: Subject to any disclaimer, the term of this patent is extended or adjusted under 35 U.S.C. 154(b) by 688 days.

(21) Appl. No.: 14/036,577

(22) Filed: Sep. 25, 2013

(65) Prior Publication Data

US 2015/0083492 A1 Mar. 26, 2015

(51) Int. Cl.

| | |
|---|---|
| ***G06G 7/48*** | (2006.01) |
| ***E21B 44/00*** | (2006.01) |
| ***E21B 41/00*** | (2006.01) |
| ***E21B 47/00*** | (2012.01) |

(52) U.S. Cl.

CPC ..... *E21B 44/00* (2013.01); *E21B 41/00* (2013.01); *E21B 47/0006* (2013.01)

(58) Field of Classification Search

None

See application file for complete search history.

(56) References Cited

U.S. PATENT DOCUMENTS

| | | | |
|---|---|---|---|
| 2,309,941 | A | 2/1943 | Drummond |
| 3,507,341 | A | 4/1970 | Basgan |
| 3,626,482 | A | 12/1971 | Quichaud et al. |
| 3,813,656 | A | 5/1974 | Fowler |
| 4,019,148 | A | 4/1977 | Shawhan |
| 4,120,198 | A | 10/1978 | Tanguy et al. |
| D253,691 | S | 12/1979 | Bljumshtein |
| D253,811 | S | 1/1980 | Bljumshtein |
| 4,254,481 | A | 3/1981 | Smither et al. |
| D263,125 | S | 2/1982 | Taylor |
| 4,380,172 | A | 4/1983 | Imam et al. |
| 4,507,735 | A | 3/1985 | Moorehead et al. |
| D293,422 | S | 12/1987 | Nunes |
| 4,715,451 | A | 12/1987 | Bseisu et al. |

(Continued)

FOREIGN PATENT DOCUMENTS

| | | | |
|---|---|---|---|
| CN | 1346929 | A | 5/2002 |
| CN | 2721874 | Y | 8/2005 |

(Continued)

OTHER PUBLICATIONS

Pessier et al. Quantifying Common Drilling Problems with Mechanical Specific Energy and a Bit-Specific Coefficient of Sliding Friction SPE 24584, 1992.*

(Continued)

*Primary Examiner* — Rehana Perveen
*Assistant Examiner* — Cuong V Luu
(74) *Attorney, Agent, or Firm* — Offit Kurman, P.C.; Gregory A. Grissett

(57) ABSTRACT

A drilling system and associated systems and methods for monitoring, controlling, and predicting vibration of a drilling operation. The vibration information can include axial, lateral or torsional vibration of a drill string.

19 Claims, 10 Drawing Sheets

(56) References Cited

U.S. PATENT DOCUMENTS

D302,394 S 7/1989 Merrell
4,903,245 A 2/1990 Close et al.
D307,127 S 4/1990 Simons
4,954,998 A 9/1990 Rector
4,958,125 A 9/1990 Jardine et al.
4,968,930 A 11/1990 Grupp et al.
5,141,061 A 8/1992 Henneuse
5,160,925 A 11/1992 Dailey et al.
5,220,963 A 6/1993 Patton
5,226,332 A 7/1993 Wassell
5,259,468 A 11/1993 Warren et al.
5,269,383 A 12/1993 Forrest
5,314,030 A 5/1994 Peterson et al.
5,332,048 A 7/1994 Underwood et al.
5,358,059 A 10/1994 Ho
5,368,108 A 11/1994 Aldred et al.
5,448,911 A 9/1995 Mason
5,646,611 A 7/1997 Dailey et al.
D384,341 S 9/1997 Hoffman
5,721,376 A 2/1998 Pavane et al.
5,812,068 A 9/1998 Wisler et al.
5,842,149 A * 11/1998 Harrell ..... E21B 44/00 702/9
5,857,530 A 1/1999 Gronseth
5,880,680 A 3/1999 Wisehart et al.
6,012,015 A 1/2000 Tube
6,021,377 A * 2/2000 Dubinsky ..... E21B 7/068 702/9
6,023,658 A 2/2000 Jeffryes
6,088,294 A 7/2000 Leggett, III et al.
6,092,610 A 7/2000 Kosmala et al.
6,101,444 A 8/2000 Stoner
6,205,851 B1 3/2001 Jogi
6,206,108 B1 3/2001 MacDonald et al.
6,227,044 B1 5/2001 Jarvis
6,233,524 B1 5/2001 Harrell et al.
6,272,434 B1 8/2001 Wisler et al.
6,296,066 B1 10/2001 Terry et al.
6,308,787 B1 10/2001 Alft
6,310,559 B1 10/2001 Laborde et al.
D452,693 S 1/2002 Mitchell
6,347,282 B2 2/2002 Estes
6,371,204 B1 4/2002 Singh et al.
6,405,808 B1 6/2002 Edwards et al.
6,415,878 B1 7/2002 Cargill et al.
6,419,014 B1 7/2002 Meek et al.
6,466,235 B1 10/2002 Smith
D465,167 S 11/2002 Hayashi
6,547,016 B2 4/2003 Wassell
6,564,883 B2 5/2003 Fredericks et al.
6,609,579 B2 8/2003 Krueger et al.
6,637,523 B2 10/2003 Lee et al.
6,637,524 B2 10/2003 Kruspe et al.
6,662,110 B1 12/2003 Bargach et al.
6,714,138 B1 3/2004 Tumet
6,732,052 B2 5/2004 MacDonald
D493,397 S 7/2004 Tuzar
6,785,641 B1 8/2004 Huang
D496,940 S 10/2004 Fetterman
6,820,702 B2 11/2004 Niedermayr
D499,367 S 12/2004 Sauter
6,883,393 B2 4/2005 Tadaaki
D511,167 S 11/2005 Blencowe
D511,704 S 11/2005 Zwingmann
6,968,909 B2 11/2005 Aldred
D514,996 S 2/2006 Rayburn
7,003,439 B2 2/2006 Aldred
7,054,750 B2 5/2006 Rodney
7,064,676 B2 6/2006 Hall et al.
D525,550 S 7/2006 Egidio
7,073,125 B1 7/2006 Nystrom
7,100,688 B2 9/2006 Stephenson et al.
7,140,452 B2 11/2006 Hutchinson
7,142,986 B2 11/2006 Moran
D533,474 S 12/2006 Megale
7,168,506 B2 1/2007 Boucher et al.
7,172,037 B2 2/2007 Dashevskiy
D543,139 S 5/2007 Kraus
D543,476 S 5/2007 Barmettler
7,219,747 B2 5/2007 Gleitman et al.
7,225,879 B2 6/2007 Wylie et al.
D545,707 S 7/2007 Barmettler
7,243,719 B2 7/2007 Baron
7,243,735 B2 * 7/2007 Koederitz ..... E21B 45/00 175/40
7,251,590 B2 7/2007 Huang
D549,721 S 8/2007 Ito
D549,722 S 8/2007 Ito
D552,121 S 10/2007 Carl
D553,142 S 10/2007 Blencowe
D553,143 S 10/2007 Blencowe
D553,144 S 10/2007 Blencowe
D555,164 S 11/2007 Sergio
7,313,480 B2 12/2007 Chen et al.
7,327,634 B2 2/2008 Perry
D563,977 S 3/2008 Carl
7,357,197 B2 4/2008 Schultz et al.
D568,776 S 5/2008 Hall
7,441,189 B2 10/2008 Michaels
D581,302 S 11/2008 Wyszogrod
D589,388 S 3/2009 Sauter
7,502,455 B2 3/2009 Tadaaki
D602,037 S 10/2009 Nash
D603,283 S 11/2009 Colussi
7,620,459 B2 11/2009 Renner
D611,861 S 3/2010 Wiedeman
7,681,663 B2 3/2010 Cobern
7,726,255 B2 6/2010 Nakamichi
7,735,579 B2 6/2010 Gopalan et al.
7,748,474 B2 7/2010 Watkins
7,775,099 B2 8/2010 Bogath et al.
D629,410 S 12/2010 Ray
D631,808 S 2/2011 Yamazaki
7,913,773 B2 3/2011 Li et al.
D637,196 S 5/2011 Ray
D644,574 S 9/2011 Vardis
D650,300 S 12/2011 Fujioka
D654,415 S 2/2012 Mizuno
8,121,971 B2 2/2012 Edwards
8,180,614 B2 5/2012 Pabon
8,210,283 B1 7/2012 Benson
8,214,188 B2 7/2012 Bailey
D667,434 S 8/2012 Phelan
D671,022 S 11/2012 Hoffman
D673,487 S 1/2013 Hanson
8,397,562 B2 3/2013 Wassell
D681,649 S 5/2013 Fletcher
D681,662 S 5/2013 Fletcher
D681,670 S 5/2013 Fletcher
8,443,764 B2 5/2013 Herstad
D683,645 S 6/2013 Bode
8,453,764 B2 6/2013 Turner
D687,043 S 7/2013 Matas
8,504,342 B2 8/2013 Bailey
8,525,690 B2 9/2013 Puro
8,577,487 B2 11/2013 Tarte
8,622,153 B2 1/2014 McLoughlin
8,640,791 B2 2/2014 Turner
D701,226 S 3/2014 Jung
D701,869 S 4/2014 Matas
8,684,108 B2 4/2014 Turner
8,798,978 B2 8/2014 Ertas
8,817,024 B2 8/2014 Katoh
8,838,426 B2 9/2014 Aldred
8,977,523 B2 3/2015 Ertas
D729,839 S 5/2015 Bray
D731,545 S 6/2015 Lim
D744,494 S 12/2015 Roberts
D745,054 S 12/2015 Bray
9,249,654 B2 2/2016 Strachan
D755,240 S 5/2016 Cavander
D755,825 S 5/2016 Hwang
D778,303 S 2/2017 Deusing et al.
D786,913 S 5/2017 Dye

(56) References Cited

U.S. PATENT DOCUMENTS

| | | | | |
|---|---|---|---|---|
| D788,154 | S | 5/2017 | Kim et al. | |
| D788,792 | S | 6/2017 | Alessandri et al. | |
| D799,519 | S | 10/2017 | Broughton et al. | |
| D800,144 | S | 10/2017 | Anderson | |
| D800,163 | S | 10/2017 | Tsukahara | |
| D800,739 | S | 10/2017 | Sukumaran et al. | |
| D801,368 | S | 10/2017 | Broughton et al. | |
| D801,369 | S | 10/2017 | Chaudhri et al. | |
| D802,020 | S | 11/2017 | Kim et al. | |
| 2002/0011358 | A1 | 1/2002 | Wassell | |
| 2002/0088648 | A1 | 7/2002 | Krueger et al. | |
| 2002/0120401 | A1 | 8/2002 | MacDonald | |
| 2003/0056608 | A1 | 3/2003 | Tadaaki | |
| 2003/0168257 | A1 | 9/2003 | Aldred | |
| 2004/0111507 | A1 | 6/2004 | Villado | |
| 2004/0256152 | A1 | 12/2004 | Dashevskiy | |
| 2005/0010382 | A1* | 1/2005 | Oliver | E21B 10/00 703/7 |
| 2005/0109097 | A1 | 5/2005 | Bogath | |
| 2005/0197777 | A1 | 9/2005 | Rodney | |
| 2006/0065440 | A1 | 3/2006 | Hutchinson | |
| 2006/0195265 | A1 | 8/2006 | Schen et al. | |
| 2006/0195307 | A1 | 8/2006 | Huang | |
| 2006/0215491 | A1 | 9/2006 | Hall | |
| 2007/0029112 | A1 | 2/2007 | Li | |
| 2007/0056771 | A1 | 3/2007 | Gopalan | |
| 2007/0061081 | A1 | 3/2007 | Moran | |
| 2007/0289778 | A1 | 12/2007 | Fincher | |
| 2007/0295537 | A1* | 12/2007 | Fincher | E21B 7/24 175/56 |
| 2008/0060849 | A1* | 3/2008 | Entchev | E21B 17/00 175/56 |
| 2008/0238913 | A1 | 10/2008 | Katoh | |
| 2009/0073186 | A1 | 3/2009 | Caniglia | |
| 2010/0139977 | A1 | 6/2010 | Watkins | |
| 2010/0163306 | A1 | 7/2010 | Pabon | |
| 2010/0214121 | A1 | 8/2010 | Puro | |
| 2011/0024188 | A1 | 2/2011 | Wassell | |
| 2011/0029919 | A1 | 2/2011 | Woltkamp | |
| 2011/0120772 | A1* | 5/2011 | McLoughlin | E21B 17/05 175/56 |
| 2011/0186353 | A1* | 8/2011 | Turner | G05B 13/048 175/40 |
| 2011/0214878 | A1 | 9/2011 | Bailey | |
| 2011/0220410 | A1 | 9/2011 | Aldred | |
| 2012/0048621 | A1* | 3/2012 | Stewart | E21B 7/04 175/56 |
| 2012/0123757 | A1 | 5/2012 | Ertas | |
| 2012/0130693 | A1 | 5/2012 | Ertas | |
| 2012/0222900 | A1 | 9/2012 | Rodney | |
| 2012/0272186 | A1 | 10/2012 | Kraut | |
| 2013/0092438 | A1 | 4/2013 | Turner | |
| 2013/0098683 | A1 | 4/2013 | Turner | |
| 2013/0146358 | A1* | 6/2013 | DiSantis | E21B 7/00 175/27 |
| 2014/0238662 | A1* | 8/2014 | Prieto | F16F 15/005 166/244.1 |
| 2014/0251688 | A1* | 9/2014 | Turner | G05B 13/048 175/45 |
| 2015/0014058 | A1 | 1/2015 | Wassell | |

FOREIGN PATENT DOCUMENTS

| | | | |
|---|---|---|---|
| CN | 101223335 | A | 7/2008 |
| CN | 101446191 | A | 6/2009 |
| CN | 102822752 | A | 12/2012 |
| CN | 104295233 | A | 12/2012 |
| CN | 202832481 | U | 3/2013 |
| DE | 3434565 | A1 | 3/1986 |
| GB | 2335450 | A1 | 9/1999 |
| GB | 2467626 | A | 8/2010 |
| GB | 2492906 | A | 1/2013 |
| GB | 2518282 | A | 3/2015 |
| WO | WO 97/046793 | A1 | 12/1997 |
| WO | WO 99/928594 | A1 | 6/1999 |
| WO | WO 2007 149866 | A2 | 12/2008 |
| WO | WO 2010 059295 | A1 | 5/2010 |
| WO | WO 2011 017626 | A1 | 2/2011 |
| WO | WO 2011 094689 | A1 | 8/2011 |
| WO | WO 2014 011171 | A1 | 1/2014 |

OTHER PUBLICATIONS

Pessier et al. Quantifying Common Drilling Problems With Mechanical Specific Energy and a Bit-Specific Coefficient of Sliding Friction Society of Petroleum Engineers Inc., Oct. 1992.*

Peterson et al. Computer Analysis and Field Measurements of Stress in Long Drill String Suspended From a Floating Vessel Scripps lnstn. Oceanography, Technical Report 22, Jul. 1984 (Year: 1984).*

CN 102822752 A Dec. 12, 2012 Turner (Abstract).

CN 104295233 A Dec. 12, 2012 Wassell (Abstract).

Mazerov, "MWD/LWD Advances Push Telemetry Rates Higher, Expand Capabilities in Horizontal, HPHT, Deepwater Environments," Innovating While Drilling, Drilling Contractor Jul.-Aug. 2013, p. 63-73.

Mazerov, "MWD LWD Advances Push Telemetry Rates Higher, Expand Capabilities in Horizontal, HPHT, Deepwater Environments," Data Delivery Drilling Contractor_drillingcontractor.org_data-delivery-03-23869_11July2013_6 pgs.

APS Technology, Vibration Isolation Subs (VIS™), 2009, Rev. 090807, vA.

F. Dupriest & W. Koederitz, "Maximizing Drill Rates With Real-Time Surveillance of Mechanical Specific Energy," SPEAADC Drilling Conference, SPEAADC 92194 (2005).

W. Koederitz & J. Weis, A Real-Time Implementation of MSE, American Association of Drilling Engineers, AADE-05-NTCE-66 (2005).

Mihajlovic et al., Analysis of Friction-Induced Limit Cycling in an Experimental Drill, J. Dynamic Systems Measurement and Control, ASME, Dec. 2004, V. 126, pp. 709-720.

Abstract_Pushkar et al., Field Verification of Model-Derived Natural Frequencies of a Drill String, J. Energy Resour. Tech, Sep. 2002, V 124, Issue 3, 154.

Tech Power Controls Co Composite Catalog, Houston, Texas (2000).

DE 3434565 Mar. 27, 1986 Freisl (Abstract).

Johancsik et al., "Torque and Drag in Directional Wells-Prediction and Measurement," SPE, Jun. 1984, pp. 987-992.

Samuel et al, "Tortuosity Factors for Highly Tortuous Wells: A Practical Approach," SPE/IADC Drilling Conference, SPE/IADC 92565 (2005).

International Patent Application No. PCT/US2011/023179: Notification of Transmittal of the International Search Report and the Written Opinion of the International Searching Authority dated Mar. 25, 2011.

Chinese Patent Application No. 201410327955.8: First Office Action dated May 27, 2017, 11 pages (translation unavailable).

Simon, R., "Energy Balance in Rock Drilling", Society of Petroelum Engineers, Dec. 1963, 2 pages, (Abstract).

Xue et al., Reseach Status and Developent Trend of Drill String Vibration Logging, Oil Drilling Technology, vol. 37, No. 5, Sep. 25, 2009, 5 pp.

Chinese Office Action, Chinese Patent Application 201410495272.3, dated Aug. 28, 2018, 12 pp.

APS Technology. Vibration Memory Sub (VMS™) Technical Data Sheet, 2009.

APS Technology, WellDrill™ Analytical Software for Downhole Drilling Equipment, 2009.

APS Technology, WellDrill Users Guide, v6, Feb. 2008.

APS Technology, SureShot™ Surface Systems & Components, 2009.

APS Technology, Vibration Memory Module (VMM™) Technical Data Sheet, 2009.

APS Technology, Advanced Systems for Drilling Performance, 2009.

Apostal et al, SPE 20458—"A Study to Determine the Effect of Damping on Finite-Element-Based, Forced-Frequency-Response

(56) References Cited

OTHER PUBLICATIONS

Models for Bottom Hole Assembly Vibration Analysis", 1990, 65th Annual Technical Conference and Exhibition of the Society of Petroleum Engineers held in New Orleans, LA, Sep. 23-26, 1990, 537-550.
APS Technology, "Vibration Isolation Sub", (VMS™), APS Technology, Rev. 090804-vA, © 2009, 2 pages.
APS Technology, "Vibration Memory Module", (VMM™) Technical Data Sheet, Rev. 090805-vA.01, © 2009, 3 pages.

* cited by examiner

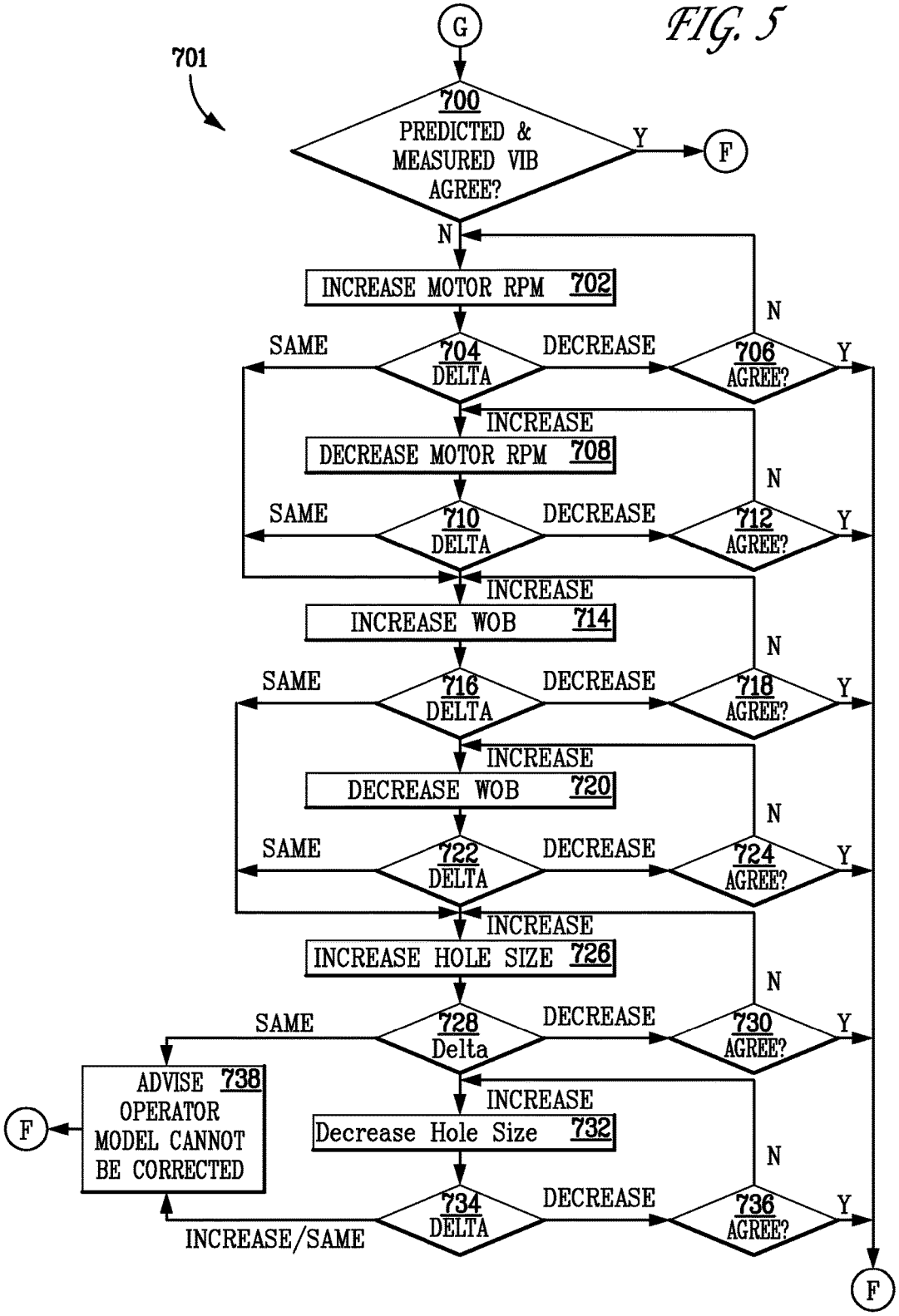
FIG. 5
701
G
700
PREDICTED & MEASURED VIB AGREE?
Y
F
N
INCREASE MOTOR RPM 702
SAME
704 DELTA
DECREASE
706 AGREE?
N
Y
INCREASE
DECREASE MOTOR RPM 708
SAME
710 DELTA
DECREASE
712 AGREE?
N
Y
INCREASE
INCREASE WOB 714
SAME
716 DELTA
DECREASE
718 AGREE?
N
Y
INCREASE
DECREASE WOB 720
SAME
722 DELTA
DECREASE
724 AGREE?
N
Y
INCREASE
INCREASE HOLE SIZE 726
SAME
728 Delta
DECREASE
730 AGREE?
N
Y
ADVISE 738 OPERATOR MODEL CANNOT BE CORRECTED
F
INCREASE
Decrease Hole Size 732
734 DELTA
DECREASE
736 AGREE?
N
Y
INCREASE/SAME
F

DRILLING SYSTEM AND ASSOCIATED SYSTEM AND METHOD FOR MONITORING, CONTROLLING, AND PREDICTING VIBRATION IN AN UNDERGROUND DRILLING OPERATION

TECHNICAL FIELD

The present disclosure relates to a drilling system for underground drilling, and more particularly to a method for monitoring, controlling and predicting vibration in a drilling operation.

BACKGROUND

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface to the bottom of the bore. The drill bit is rotated so that the drill bit advances into the earth, thereby forming the bore. In rotary drilling, the drill bit is rotated by rotating the drill string at the surface. Pumps at the surface pump high-pressure drilling mud through an internal passage in the drill string and out through the drill bit. The drilling mud lubricates the drill bit, and flushes cuttings from the path of the drill bit. In some cases, the flowing mud also powers a drilling motor, commonly referred to as a "mud motor," which turns the bit. In any event, the drilling mud flows back to the surface through an annular passage formed between the drill string and the surface of the bore. In general, optimal drilling is obtained when the rate of penetration of the drill bit into the formation is as high as possible while a vibration of drilling system is as low as possible. The rate of penetration ("ROP") is a function of a number of variables, including the rotational speed of the drill bit and the weight-on-bit ("WOB"). The drilling environment, and especially hard rock drilling, can induce substantial vibration and shock into the drill string, which has an adverse impact of drilling performance.

Vibration is introduced by rotation of the drill bit, the motors used to rotate the drill bit, the pumping of drilling mud, imbalance in the drill string, etc. Vibration can cause premature failure of the various components of the drill string, premature dulling of the drill bit, or may cause the catastrophic failures of drilling system components. Drill string vibration includes axial vibration, lateral vibration and torsional vibration. "Axial vibration" refers to vibration in the direction along the drill string axis. "Lateral vibration" refers to vibration perpendicular to the drill string axis. Lateral vibration often arises because the drill string rotates in a bent condition. Two other sources of lateral vibration are "forward" and "backward", or "reverse", whirl. "Whirl" refers to a situation in which the bit orbits around the borehole in addition to rotating about its own axis. In backward whirl, the bit orbits in a direction opposite to the direction of rotation of the drill bit. "Torsional vibration," also of concern in underground drilling, is usually the result of what is referred to as "stick-slip." Stick-slip occurs when the drill bit or lower section of the drill string momentarily stops rotating (i.e., "sticks") while the drill string above continues to rotate, thereby causing the drill string to "wind up," after which the stuck element "slips" and rotates again. Often, the bit will over-speed as it unwinds.

Various system can be used to obtain and process information concerning a drilling operation, which can help improve drilling efficiency. Systems have been developed that can receive and process information from sensors near the drill bit and then transmit that information to surface equipment. Other systems can determine vibration of the bottomhole assembly, either downhole during a drill run, or at the surface. Many of such systems use finite element and/or finite difference techniques to assist in in analysis of drilling data, including vibration information.

SUMMARY

An embodiment of the present disclosure includes a method for monitoring and controlling a drilling system that includes a drill string and a drill bit supported at a downhole end of the drill string. The drilling system is configured to form a borehole in an earthen formation. The method comprising the step of predicting, via a drilling system model, vibration information for the drill string based on a set of drilling operating parameters, a borehole information, and a drilling system component information. The set of drilling operating parameters include a weight-on-bit (WOB) and a drill bit rotational speed. The drilling system component information includes one or more characteristics of the drill string and the drill bit. The predicted vibration information includes an amplitude for at least one of a axial vibration, lateral vibration, and a torsional vibration of the drill string. The drilling system model is configured to predict vibration information based on an energy balance of the drill string operating according to the set of drilling operating parameters during an expected drilling operation. The method includes operating the drilling system to drill the borehole in the earthen formation according to the set of drilling operating parameters and obtaining data in the borehole during the drilling operation, the data being indicative at least one of the axial vibration, lateral vibration, and a torsional vibration of the drill string. The method includes comparing the predicted vibration information for the drill string and the drill bit to the measured vibration information for the drill string and the drill bit, and if the step of comparing results in a difference between the expected and measured vibration information for each of the drill string and the drill bit, updating the drilling system model to reduce the difference between the expected and measured vibration information for the drill string and the drill bit.

Another embodiment of the present disclosure is a drilling system configured to form a borehole in an earthen formation during a drilling operation. The drilling system includes a drill string supporting a drill bit. The drill bit configured to defined the borehole. The drilling system includes a plurality of sensors configured to obtain drilling operation information and measured vibration information, wherein one or more of the plurality of sensors are configured to obtain, in the borehole during the drilling operation, data that is indicative the axial vibration, lateral vibration, and a torsional vibration of the drill string, the obtained data indicative of the measured vibration information. The drilling system includes at least one computing device including a memory portion having stored thereon drilling system component information, the drilling system component information including one or more characteristics of the drill string, the memory portion further including expected operating information for the drilling operation, the expected operating information including at least a weight-on-bit (WOB), a rotational speed of the drill bit, a borehole diameter, and a vibration damping coefficient. The drilling system further includes a computer processor in communication with the memory portion, the computer processor configured to predict vibration information for the drill string, the predicted vibration information including at least a predicted amplitude for at least one of an axial vibration, a lateral vibration, and a torsional vibration of the drill string, the predicted vibration information being based on the drilling system component information and an energy balance of the drill string operating according to the expected operation information for the drilling operation. The computing processor being further configured to compare the predicted vibration information for the drill string and the drill bit to the measured vibration information for the drill string and the drill bit, wherein the computing device is configured to update the drilling system model if there a difference between the expected and measured vibration information is detected.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments. It should be understood, however, that the application is not limited to the precise arrangements and instrumentalities shown. In the drawings:

FIG. 5 is a block diagram illustrating a method for revising the drilling system model to reduce deviations between predicted and measured vibration according to an embodiment of the present disclosure.

DETAILED DESCRIPTION OF ILLUSTRATIVE EMBODIMENTS

Figure 1:
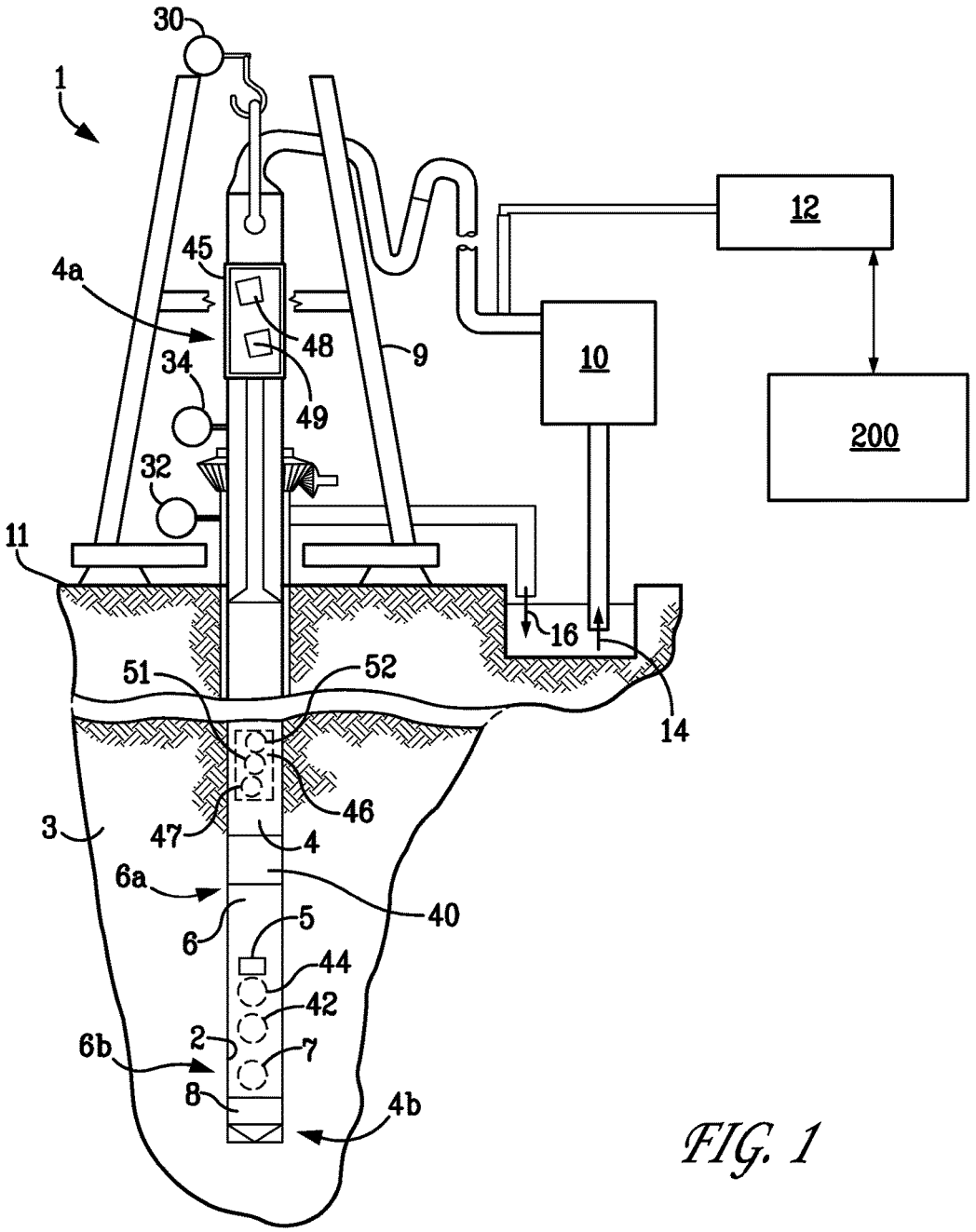
FIG. 1 is a schematic of an underground drilling system according to an embodiment of the present disclosure.

Referring to FIG. 1, a drilling system or drilling rig 1 is configured to drill a borehole 2 in an earthen formation 3 during a drilling operation. The drilling system 1 includes a drill string 4 for forming the borehole 2 in the earthen formation 3, a drilling data system 12, and at least one computing device 200. The computing device 200 can host one or more drilling operation applications, for instance software applications, that are configured to perform various methods for monitoring the drilling operation, controlling the drilling operation, predicting vibration information concerning the drilling operation, and/or predicting vibration information concerning the drill string 4 for use in a drilling operation. The computing device 200 cooperates with the drilling data system 12 and the one or more software application to execute the various methods described herein. While the borehole 2 is illustrated as a vertical borehole, the systems and methods described herein can be used for a directional drilling operation, i.e, horizontal drilling. For instance, the drill string 4 can be configured to form a borehole 2 in the earthen formation 3 that is orientated along a direction that is transverse to an axis that is perpendicular to the surface 11 of the earthen formation 3.

Continuing with FIG. 1, the drilling system or rig 1 includes a derrick 9 supported by the earth surface 11. The derrick 9 supports a drill string 4. The drill string 4 has a top end 4*a*, a bottom end 4*b*, a top sub 45 disposed at the top end 4*a* of the drill string 4, and a bottomhole assembly 6 disposed at the bottom end 4*b* of the drill string 4. The bottomhole assembly 6 includes top end 6*a* and a bottom end 6*b*. A drill bit 8 is coupled to the bottom end 6*b* of a bottomhole assembly 6. The drilling system 1 has a prime mover (not shown), such as a top drive or rotary table, configured to rotate the drill string 4 so as to control the rotational speed (RPM) of, and torque on, the drill bit 8. Rotation of the drill string 4 and drill bit 8 thus defines the borehole 2. As is conventional, a pump 10 is configured to pump a fluid 14, for instance drilling mud, downward through an internal passage in the drill string 4. After exiting at the drill bit 8, the returning drilling mud 16 flows upward to the surface 11 through an annular passage formed between the drill string 4 and the borehole 2 in the earthen formation 3. A mud motor 40, such as a helicoidal positive displacement pump or a "Moineau-type" pump, may be incorporated into the bottomhole assembly 6. The mud motor is driven by the flow of drilling mud 14 through the pump and around the drill string 4 in the annular passage described above.

A drilling operation as used herein refers to one more drill runs that define the borehole 2. For instance a drilling operation can include a first drill run for defining a vertical section of the borehole 2, a second drill run for defining the bent section of the borehole 2, and a third drill run for defining a horizontal section of the borehole 2. More than three drill runs are possible. For difficult drilling operations, as much as 10 to 15 drill runs may be completed to define the borehole 2 for hydrocarbon extraction purposes. It should be appreciated that one or more bottomhole assemblies can be used for each respective drill run. The systems, methods, software applications as described herein can be used to execute methods that monitor, control, and predict vibration information the drilling operation, as well as monitor, control, and prediction vibration information for specific drilling runs in the drilling operation.

In the illustrated embodiment, the computing device 200 can host the software application that is configured to predict vibration information for the drill string 4 using a drilling system model, as will be further detailed below. The vibration information can include the axial, lateral and torsional vibration information of the drill string 4, and specifically, the mode shape and frequency for each of an axial, lateral, and torsional vibration of the drill string 4. It should be appreciated that vibration mode shape is indicative of the relative displacements along the drill string. As an advancement on prior systems, the software application as described herein can predict vibration information noted above based on the drill string geometry, the applied drilling loads based on the expected drilling operation (e.g. expected weight-on-bit, rotary speed and flow rate). In predicting vibration information, the software application takes into account the energy balance to determine the vibration severity based on a frequency domain type of finite element technique, as further detailed below. A software application based on the energy balance of the drilling system 1, as opposed to a software application that uses various finite element techniques based on time domain, result in significant processing time improvements. The software applications ability to revise predicted vibration information based on real-time data from a drilling operation, as discussed below, results in more precise and accurate drilling operation information that the rig operator or drill string designer can reply upon. During a drilling operation, the software application described herein can be used predict anticipated drilling dysfunctions, such a component wear and potential lost time incidents due to component replacement, and can further determine modified drilling set points to avoid the drilling dysfunction. Further, the software application can predict vibration information for the drill string 4, access data indicative of the measured vibration of the drill string 4, and revise the predicted vibration information in the event there is a difference between the predicted vibration information and the measured vibration, as will be further detailed below.

Referring to FIG. 1, the drilling system 1 can include a plurality of sensors configured to measure drilling data during a drilling operation, for use in methods described herein. Drilling data can include expected operating parameters, for instance the expected operating parameter for WOB, rotary speed (RPM) and the drill bit rotational speed (RPM). In the illustrated embodiment, the drill string top sub 45 includes one or more sensors for measuring drilling data. For instance, the one or more sensors can be strain gauges 48 that measure the axial load (or hook load), bending load, and torsional load on the top sub 45. The tob sub 45 sensors also include a triaxial accelerometer 49 that senses vibration at the top end 4*a* of the drill string 4.

Continuing with FIG. 1, the bottomhole assembly 6 can also include one or more sensors that are configured to measure drilling parameters in the borehole 2. In addition, the bottomhole assembly 6 includes a vibration analysis system 46 configured to determine various vibration parameters based on the information regarding the drilling operation obtained from the sensors in the borehole. The vibration analysis module will be further detailed below. The bottomhole assembly sensors can be in the form of strain gauges, accelerometers, pressure gauges and magnetometers. For instance, the bottomhole assembly 6 can include downhole strain gauges 7 that measure the WOB. A system for measuring WOB using downhole strain gauges is described in U.S. Pat. No. 6,547,016, entitled "Apparatus For Measuring Weight And Torque An A Drill Bit Operating In A Well," hereby incorporated by reference herein in its entirety. In addition, the strain gauges 7 can be configured to measure torque on bit ("TOB") and bending on bit ("BOB") as well as WOB. In alternative embodiments, the drill string can include a sub (not numbered) incorporating sensors for measuring WOB, TOB and BOB. Such a sub can be referred to as a "WTB sub."

Further, the bottomhole assembly sensors can also include at least one magnetometer 42. The magnetometer is configured to measure the instantaneous rotational speed of the drill bit 8, using, for example, the techniques in U.S. Pat. No. 7,681,663, entitled "Methods And Systems For Determining Angular Orientation Of A Drill String," hereby incorporated by reference herein in its entirety. The bottomhole assembly sensors can also include accelerometers 44, oriented along the x, y, and z axes (not shown) (typically with ±250 g range) that are configured to measure axial and lateral vibration. While accelerometer 44 is shown disposed on the bottomhole assembly 6, it should be appreciated that multiple accelerometers 44 can be installed at various locations along the drill string 4, such that axial and lateral vibration information at various location along the drill string can be measured.

As noted above, the bottomhole assembly 6 includes a vibration analysis system 46. The vibration analysis system 46 is configured to receive data from the accelerometers 44 concerning axial and lateral vibration of the drill string 4. Based on the data receive from the accelerometers, the vibration analysis system 46 can determine the measured amplitude and mode shape of axial vibration, and of lateral vibration due to forward and backward whirl, at the location of the accelerometers on the drill string 4. The measured amplitude and frequency of axial vibration and of lateral vibration can be referred to as measured vibration information. The measured vibration information can also transmitted to the surface 11 and processed by drilling data system 12 and/or the computing device 200. The vibration analysis system 46 can also receive data from the magnetometer 42 concerning the instantaneous rotational speed of the drill string at the magnetometer 42 location. The vibration analysis system 46 then determines the amplitude and frequency of torsional vibration due to stick-slip. The measured frequency and amplitude of the actual torsional vibration is determined by calculating the difference between and maximum and minimum instantaneous rotational speed of the drill string over a given period of time. Thus, the measured vibration information can also refer to the measured torsional vibration.

According to the present disclosure, to reduce data transmissions for vibration information, drilling data may be grouped into ranges and simple values used to represent data in these ranges. For example, vibration amplitude can be reported as 0, 1, 2 or 3 to indicate normal, high, severe, or critical vibration, respectively. One method that may be employed to report frequency is to assign numbers 1 through 10, for example, to values of the vibration frequency so that a value of 1 indicates a frequency in the 0 to 100 hz range, a value of 2 indicates frequency in the 101 to 200 hz range, etc. The mode of vibration may be reported by assigning a number 1 through 3 so that, for example, a value of 1 indicates axial vibration, 2 indicates lateral vibration, and 3 indicates torsional vibration. If only such abbreviated vibration data is transmitted to the surface, at least some of the data analysis, such as a Fourier analysis used in connection with the use of backward whirl frequency to determine borehole diameter, could be performed in a processor installed in the bottomhole assembly 6. {Note: Currently we don't do this, but have thought about implementing it in the future}

The bottom hole assembly sensors can also include at least first and second pressure sensors 51 and 52 that measure the pressure of the drilling mud flowing through drilling system components in the borehole 2. For instance, the first and second sensors 51 and 52 measure pressure of the drilling mud flowing through the drill string 4 (in a downhole direction), and the pressure of the drilling mud flowing through the annular gap between the borehole wall and the drill string 4 in an up-hole direction, respectively. Differential pressure is referred to as the difference in pressure between the drilling mud following in downhole direction and the drilling mud flowing in the up-hole direction. Sometimes differential pressure can be referred to as the difference in off-bottom and on-bottom pressure, as is known in the art. Pressure information can be transmitted to the drilling data acquisition system 12 and/or computing device 200. In the illustrated embodiment, the first and second pressure sensors 51 and 52 can be incorporated in the vibration analysis system 46.

Further, the drilling system 1 can also include one or more sensors disposed on the derrick 9. For instance, the drilling system can include a hook load sensor 30 for determining WOB and an additional sensor 32 for sensing drill string rotational speed of the drill string 4. The hook load sensor 30 measures the hanging weight of the drill string, for example, by measuring the tension in a draw works cable (not numbered) using a strain gauge. The cable is run through three supports and the supports put a known lateral displacement on the cable. The strain gauge measures the amount of lateral strain due to the tension in the cable, which is then used to calculate the axial load, and WOB. In another embodiment, drill data can be obtained using an electronic data recorder (EDR). The EDR can measure operating loads at the surface. For instance, the EDR can use sensors to measure the hook load (tensile load to of the drill string at the surface), torque, pressure, differential pressure, rotary speed, flow rate. The weight-in-bit (WOB) can be calculated from the hook load, drill string weight, and off-bottom to on-bottom variations of load. Torque can measured from the motor current draw. Flow rate can be based on the counts the pump strokes and the volume pumped per stroke. The differential pressure is the difference between on-bottom and off-bottom pressure.

The drilling data system 12, as will be further detailed below, can be a computing device in electronic communication with the computing device 200. The drilling data system 12 is configured to receive, process, and store various drilling operation information obtained from the downhole sensors described above. Accordingly, the drilling data system 12 can include various systems and methods for transmitting data between drill string components and the drilling data system 12. For instance, in a wired pipe implementation, the data from the bottomhole assembly sensors is transmitted to the top sub 45. The data from the top sub 45 sensors, as well as data from the bottomhole assembly sensors in a wired pipe system, can be transmitted to the drilling data system 12 or computing device 200 using wireless telemetry. One such method for wireless telemetry is disclosed in U.S. application Ser. No. 12/389,950, filed Feb. 20, 2009, entitled "Synchronized Telemetry From A Rotating Element," hereby incorporated by reference in its entirety. In addition, the drilling system 1 can include a mud pulse telemetry system. For instance, a mud pulser 5 can be incorporated into the bottomhole assembly 6. The mud pulse telemetry system encodes data from downhole equipment, such as vibration information from the vibration analysis system 46 and, using the pulser 5, transmits the coded pulses to the surface 11. Further, drilling data can be transmitted to the surface using other means such as acoustic or electromagnetic transmission.

Figure 2A:
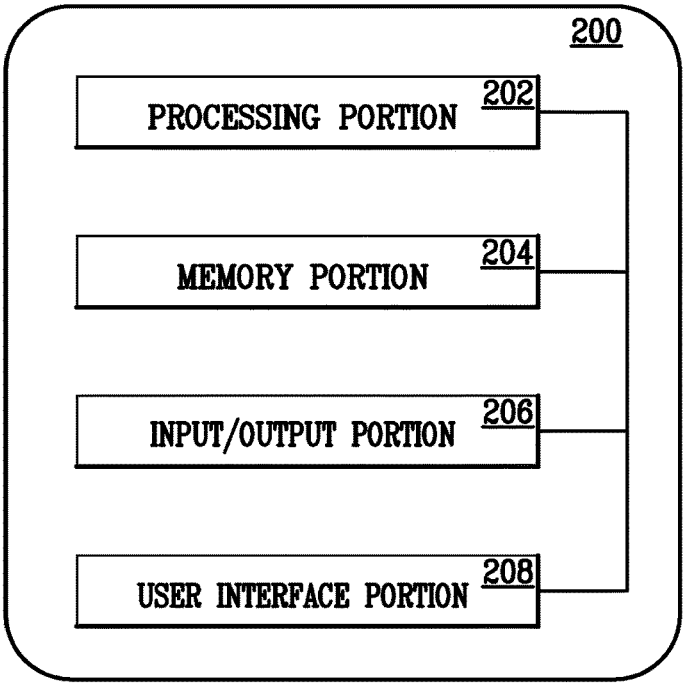
FIG. 2A is a block diagram of a computing device used in the drilling system shown in FIG. 1.

Referring to FIG. 2A, any suitable computing device 200 may be configured to host a software application for monitoring, controlling and prediction vibration information as described herein. It will be understood that the computing device 200 can include any appropriate device, examples of which include a desktop computing device, a server computing device, or a portable computing device, such as a laptop, tablet or smart phone. In an exemplary configuration illustrated in FIG. 2A, the computing device 200 includes a processing portion 202, a memory portion 204, an input/output portion 206, and a user interface (UI) portion 208. It is emphasized that the block diagram depiction of computing device 200 is exemplary and not intended to imply a specific implementation and/or configuration. The processing portion 202, memory portion 204, input/output portion 206 and user interface portion 208 can be coupled together to allow communications therebetween. As should be appreciated, any of the above components may be distributed across one or more separate devices and/or locations. For instance, any one of the processing portion 202, memory portion 204, input/output portion 206 and user interface portion 208 can be in electronic communication with the drilling data system 12, which as noted above can be a computing device similar to computing device 200 as described herein. Further, any one of the processing portion 202, memory portion 204, input/output portion 206 and user interface portion 208 can be capable of receiving drill data from one or more the sensors and/or the vibration analysis system 46 disposed on the drill string 4.

In various embodiments, the input/output portion 106 includes a receiver of the computing device 200, a transmitter of the computing device 200, or an electronic connector for wired connection, or a combination thereof. The input/output portion 206 is capable of receiving and/or providing information pertaining to communication with a network such as, for example, the Internet. As should be appreciated, transmit and receive functionality may also be provided by one or more devices external to the computing device 200. For instance, the input/output portion 206 can be in electronic communication with the data acquisition system 12 and/or one or more sensors disposed on the bottomhole assembly 6 downhole.

Depending upon the exact configuration and type of processor, the memory portion 204 can be volatile (such as some types of RAM), non-volatile (such as ROM, flash memory, etc.), or a combination thereof. The computing device 200 can include additional storage (e.g., removable storage and/or non-removable storage) including, but not limited to, tape, flash memory, smart cards, CD-ROM, digital versatile disks (DVD) or other optical storage, magnetic cassettes, magnetic tape, magnetic disk storage or other magnetic storage devices, universal serial bus (USB) compatible memory, or any other medium which can be used to store information and which can be accessed by the computing device 200.

The computing device 200 can contain the user interface portion 208, which can include an input device 209 and/or display 213 (input device 210 and display 212 not shown), that allows a user to communicate with the computing device 200. The user interface 208 can include inputs that provide the ability to control the computing device 200, via, for example, buttons, soft keys, a mouse, voice actuated controls, a touch screen, movement of the computing device 200, visual cues (e.g., moving a hand in front of a camera on the computing device 200), or the like. The user interface 208 can provide outputs, including visual information, such as the visual indication of the plurality of operating ranges for one or more drilling parameters via the display 213. Other outputs can include audio information (e.g., via speaker), mechanically (e.g., via a vibrating mechanism), or a combination thereof. In various configurations, the user interface 208 can include a display, a touch screen, a keyboard, a mouse, an accelerometer, a motion detector, a speaker, a microphone, a camera, or any combination thereof. The user interface 208 can further include any suitable device for inputting biometric information, such as, for example, fingerprint information, retinal information, voice information, and/or facial characteristic information, for instance, so to require specific biometric information for access the computing device 200.

Figure 2B:
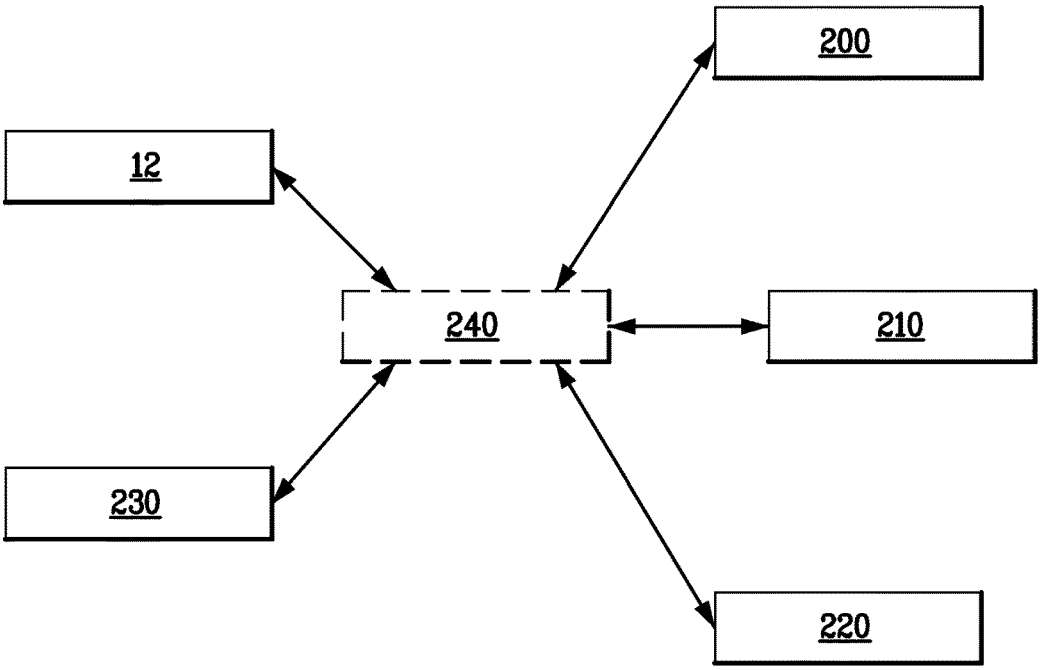
FIG. 2B is a block diagram illustrating a network of one or more computing devices and a drilling data database of the drilling system shown in FIG. 1.

Referring to FIG. 2B, an exemplary and suitable communication architecture is shown that can facilitate monitoring a drilling operation of the drilling system 1. Such an exemplary architecture can include one or more computing devices 200, 210 and 220 each of which can be in electronic communication with a database 230 and a drilling data acquisition system 12 via common communications network 240. The database 230, though schematically represented separate from the computing device 200 could also be a component of the memory portion 104 of the computing device 200. It should be appreciated that numerous suitable alternative communication architectures are envisioned. Once the drilling control and monitoring application has been installed onto the computing device 200, such as described above, it can transfer information between other computing devices on the common network 240, such as, for example, the Internet. For instance configuration, a user 24 may transmit, or cause the transmission of information via the network 240 regarding one or more drilling parameters to the computing device 210 of a supplier of the bottomhole assembly 6, or alternatively to computing device 220 of another third party (e.g., a drilling system owner 1) via the network 240. The third party can view, via a display, the plurality of operating ranges for the one or more drilling parameters as described herein.

The computing device 200 and the database 230 depicted in FIG. 2B may be operated in whole or in part by, for example, a rig operator at the drill site, a drill site owner, drilling company, and/or any manufacturer or supplier of drilling system components, or other service provider, such as a third party providing drill string design services. As should be appreciated, each of the parties set forth above and/or other relevant parties may operate any number of respective computers and may communicate internally and externally using any number of networks including, for example, wide area networks (WAN's) such as the Internet or local area networks (LAN's). Database 230 may be used, for example, to store data regarding one or more drilling parameters, the plurality of operating ranges from a previous drill run, a current drill run, and data concerning the models for the drill string components. Further it should be appreciated that "access" or "accessing" as used herein can include retrieving information stored in the memory portion of the local computing device, or sending instructions via the network to a remote computing device so as to cause information to be transmitted to the memory portion of the local computing device for access locally. In addition or alternatively, accessing can including accessing information stored in the memory portion of the remote computing device.

Figure 3A:
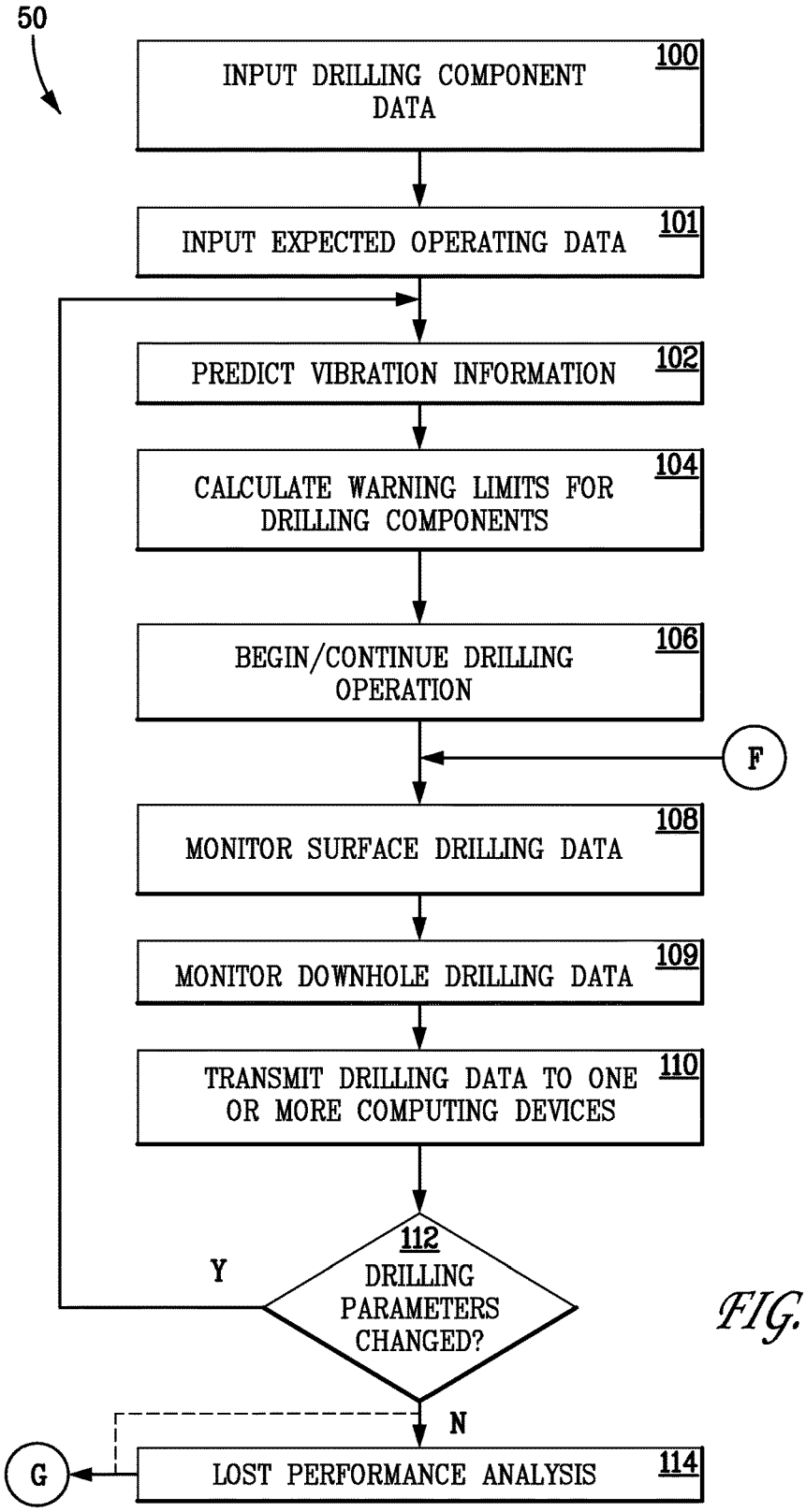
FIG. 3A is a block diagram illustrating a method of operating a drilling system shown in FIG. 1, according to an embodiment of the present disclosure.

Turning to FIG. 3A, according to an illustrated embodiment, a method 50 for monitoring, controlling of drilling data, and the prediction vibration information for a drilling operation is initiated in step 100. In step 100, a user can input drilling component data. For instance, the user may specify a drill string component, for instance a bottomhole assembly or Measurement While Drilling ("MWD") tool, and the vibration limits applicable to each such component. The drill string and/or bottomhole assembly data can be input by the operator or stored in database 230 or in memory of the computing device 100. Bottomhole assembly data can be accessed as noted above by the software application. Data input in step 100 may include:

(i) the outside and inside diameters of the drill pipe sections that make up the drill string,
(ii) the locations of stabilizers,
(iii) the length of the drill string,
(iv) the inclination of the drill string,
(v) the bend angle if a bent sub is used,
(vi) the material properties, specifically the modulus of elasticity, material density, torsional modulus of elasticity, and Poisson's ratio,
(vii) the mud properties for vibration damping, specifically, the mud weight and viscosity,
(viii) the borehole diameters along the length of the well,
(ix) the azimuth, build rate and turn rate,
(x) the diameter of the drill bit and stabilizers, and
(xi) information concerning the characteristics of the formation, such as the strike and dip.

In alternative embodiments, during step 100, the information concerning the drill string components can also be updated by the operator each time a new section of drill string is added or when a new drill run is initiated.

In step 101, expected operating information for the drilling operation can be input in the software application and stored as need in drilling data system or computing device 100. Expected operating information can developed at drill site or can be determined according to a drilling plan. Expected operating information includes (i) the WOB, (ii) the drill string rotational speed, (iii) the mud motor rotation speed, (iv) the diameter of the borehole, and (v) any damping coefficients.

In step 102, the software application predicts the vibration information for the drill string. The predicted vibration information includes at least an amplitude for each of an axial vibration, a lateral vibration, and a torsional vibration of the drill string 4. As will be further detailed below and illustrated in FIG. 3B, the prediction of the vibration information is based on the drilling system component information and an energy balance method of the drill string operating according to the expected operation information for the drilling operation. In addition, the prediction vibration information can include frequency and mode shape information. During step 102, the software application can also initiate one or more analyses for use in the prediction model discussed below. In particular, the software application can conduct a static bending analysis to determine the bending information of the bottomhole assembly 6. The bending information includes calculated bottomhole assembly deflections, the side forces along the length of the bottomhole assembly, the bending moments, and the nominal bending stress. The software application also performs a so-called "predict analysis" in which it uses the bending analysis information to predict the direction in which the drill string will drill.

In step 104, the software application calculates vibration warning limits for specific drill string components based on the vibration information measured by the sensors in the vibration analysis system 46. For example, as discussed below, based on the predicted mode shapes, the software application can determine what level of measured vibration at the accelerometer locations would result in excessive vibration at the drill string location of a critical drilling string component.

In step 106, the drilling operation continues or is initiated. For instance, one or more the previous steps, for instance steps 100 through 104, could be initiated prior to a drilling operation to help develop a drilling plan or and aid in designing a bottomhole assembly.

In step 108, the software application can receive drilling data from the rig surface sensors. In step 109, the software application can receive drilling data from the downhole sensors. It should be appreciated that the rig surface drilling data and the downhole drilling data may be stored in computer memory in the drilling data system 12 and/or computing device 200. The communication system can transmit the drilling data from the rig surface sensors and the downhole sensors to the drilling data system 12. Drilling data from the surface sensors are preferably transmitted to the system 12 continuously. Drilling data from the downhole sensors is transmitted to the drilling data system 12 whenever downhole drilling data is sent to the surface, preferably at least every few minutes. The software application can then access the rig surface drilling data and the downhole drilling data. Regardless of whether the software application accesses or receives drilling data, the drilling data can be used by the software application on an on-going basis during the drilling operation.

In step 110, drilling data and drilling status can be transmitted to a remote computing device, for instance a remote computing device 210 (FIG. 2B). Users not located at the rig site can download and review the data, for example by logging into the computing device 210, and accessing the drilling data via the communications network 240, such as the internet. In step 112, the software application determines whether any of the drilling parameters input into software application have changed. If the drilling parameters have changed, the software application updates the drilling data accordingly. Further, if the drilling parameters have not changed, in block 114, an optional lost performance analysis can be run, for instance similar to the lost performance analysis disclosed in U.S. Pat. No. 8,453,764, herein incorporated by reference. Process control can be transferred and the method 701 shown in FIG. 5 can be initiated, as will be further detailed below.

Figure 3B:
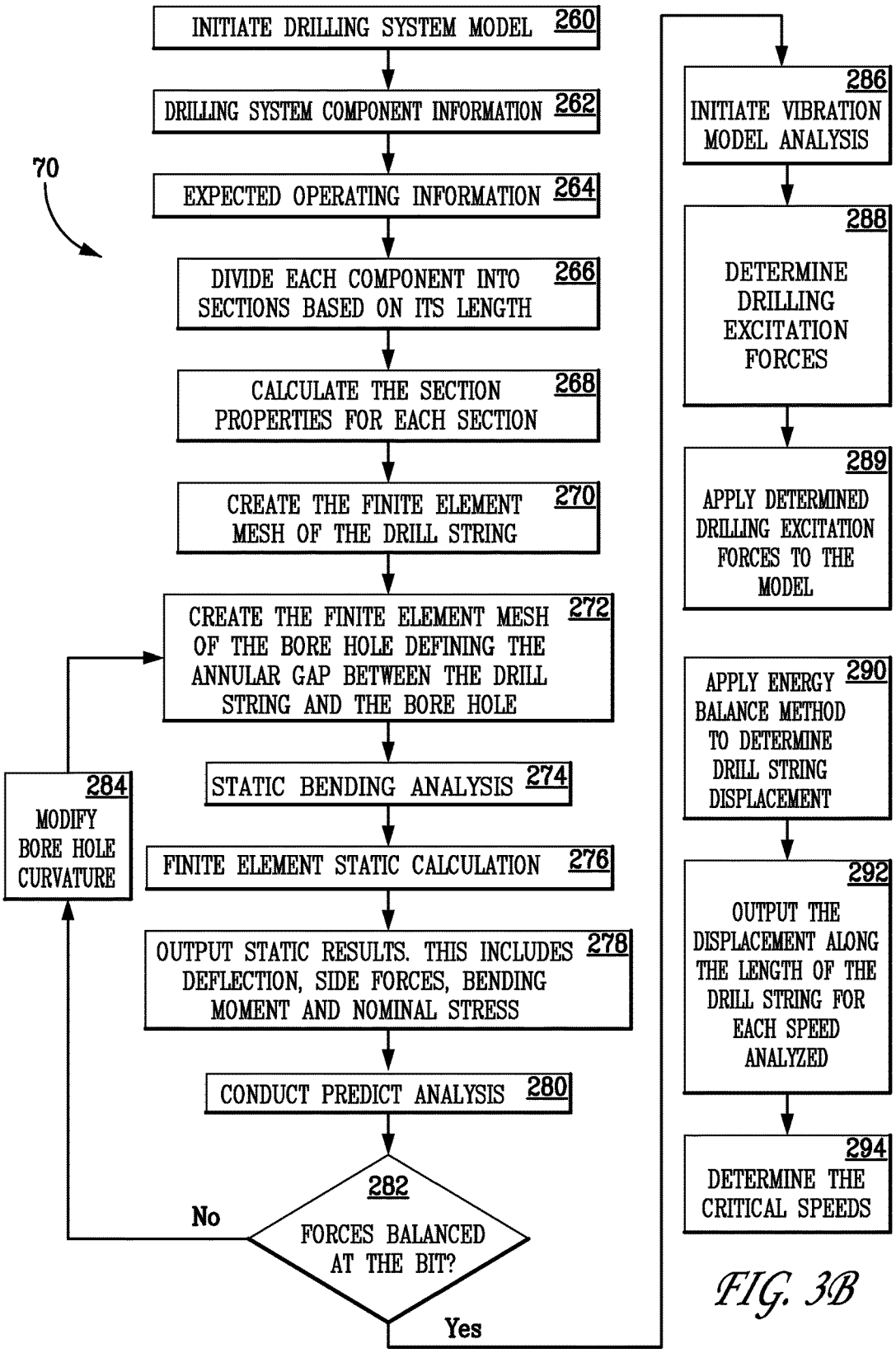
FIG. 3B is a block diagram illustrating a method of creating a drilling system model, according to an embodiment of the present disclosure.

Turning to FIG. 3B, which illustrates a method 70 for predicting vibration information for a drilling system. It should be appreciated that aspect of the method 70 can be performed prior to or along with steps 100 through 102 discussed above. FIG. 3B illustrates how a drilling system model can be developed and used in a drilling operation. Accordingly, each and every step of method 70 need not be performed at the rig site or during a drilling operation, but could occur before a drilling operation.

Continuing with FIG. 3B, the method 70 initiates in step 260, by defining a drilling system model using finite element techniques, as further detailed below. In step 260, the method can included accessing drilling system component data. The drilling system component data includes one or more characteristics of the drill string typically used in finite element models. The one or more characteristics of the drill string include drill string geometry data. Drill string geometry data includes the outside and inside diameters of the drill pipe sections that make up the drill string, the locations of stabilizers, the length of the drill string, the inclination of the drill string, the bend angle if a bent sub is used, the diameter of the drill bit and stabilizers. Drill string geometry data also includes the material properties of drill string components, specifically the modulus of elasticity, material density, torsional modulus of elasticity, and Poisson's ratio, as well as a vibration damping coefficient, based on the properties of the drilling mud properties, specifically, the mud weight and viscosity. In step 262, the software application can access borehole information. Borehole information can include borehole diameters along the length of the borehole, the azimuth, build rate, turn rate, information concerning the characteristics of the formation, such as the strike and dip.

Continuing with FIG. 3B, in steps 266 to 272, the components of the drill system model is further processed using finite element system, for instance ANSYS and/or LISA. In steps 274 to 280, the static bending analysis and the so-called predict analysis are performed. In step 282, based on the bending information determined in steps 274-280, the software application determines if the forces are balanced at the drill bit. In step 282, the software application can determine whether the side forces on the bit are equal to zero. For instance, if the forces are not balanced on the bit, then the model is indicating contact with the borehole wall (in the model). If the forces are not balanced, then process control is transferred to step 284 and the curvature of the borehole is modified, and steps 272 to 282 are re-run until a balance is obtained in step 282.

In steps 286 to 294, the software application predicts vibration information for the drill string. In step 286, the software application initiates a vibration analysis operation. For instance, the software application initiates the vibration modal analysis. The predicted vibration information includes an amplitude for the axial vibration, the lateral vibration, and the torsional vibration of the drill string. Further, frequency and the mode shape for axial, lateral and torsional vibration are developed. The prediction of the vibration information is based on the drilling system component information and an energy balance of the drill string operating according to the expected operation information, as will be further detailed below.

In step 288, the software application can first determine the drilling excitation forces of the model drilling string components. In step 289, the software application applies the determined drilling excitation forces to the model. For instance, the software application can apply known excitation loads to the drill string based on the expected operating loads and frequency of the drill string.

In step 290, the software application applies an energy balance methodology to determine vibration information along the drill string, in particular determines the amplitude of axial, lateral and torsional vibration along the drill string. Using the energy balance methodology, the predicted vibration information is based on analysis of energy supplied to the drilling operation, considering the energy dissipated during the drilling operation due to vibration of the drilling system components, as function of one or more forces applied to the drill string. The energy supplied ES (J) to a drilling system can be calculated from the equation:

$$E_S = q \cdot \pi \cdot \cos \beta \cdot \int y(x) \cdot dx, \tag{1}$$

where, q is the distributed force (N) along the drill string,

β is the phase angle (rad), and y(x) is the displacement (mm) along the length of the drill string.

The energy dissipated ED (J) from the drilling system, due to damping, etc., can be calculated from the equation:

$$ED = \pi \cdot k \cdot b \cdot Y^2, \tag{2}$$

where,

K is the spring rate, b is damping coefficient (N s/m), and

Y is displacement (mm)

Figure 7:
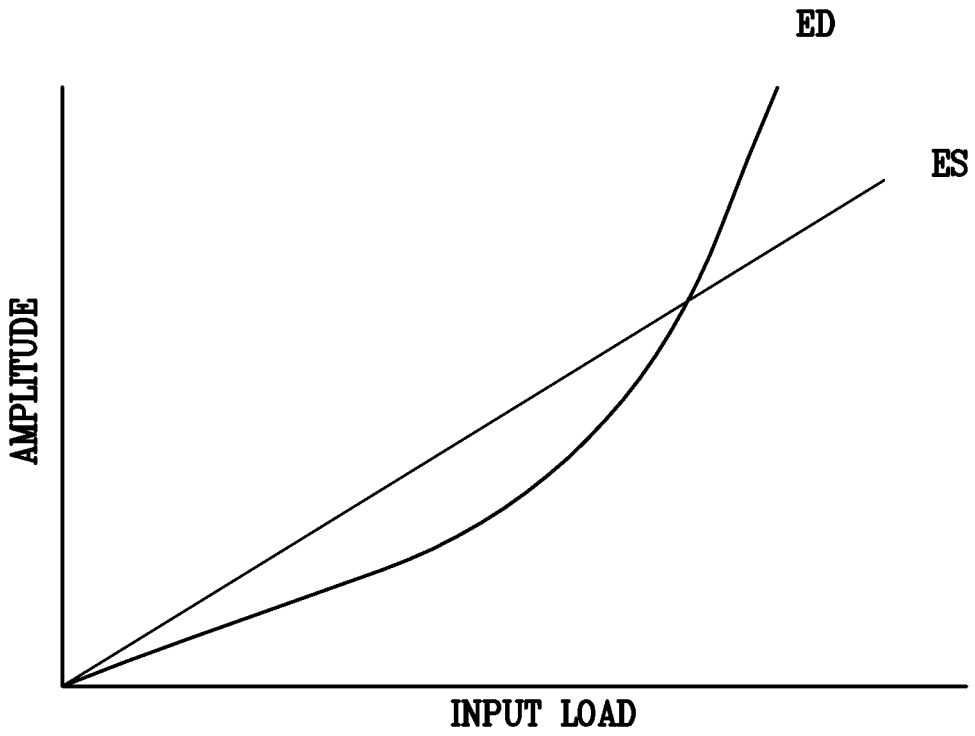
FIG. 7 is an exemplary computer generated display of an energy balance of a drilling system illustrating amplitude as a function of input load, according to the present disclosure.
Figure 8:
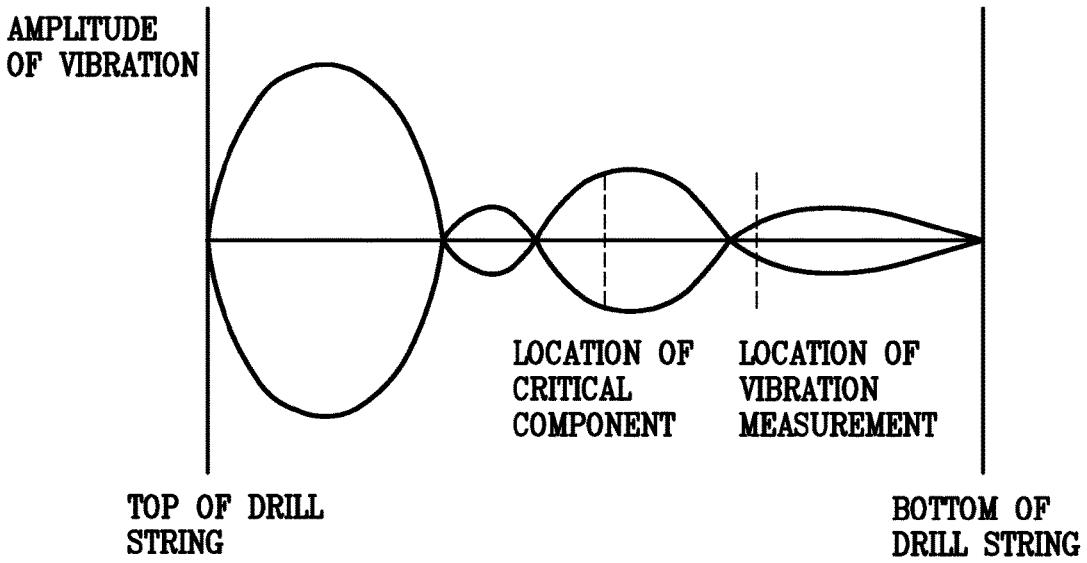
FIG. 8 is a computer generated display for an exemplary vibratory mode shape curve generated according to the present disclosure.
Figure 9:
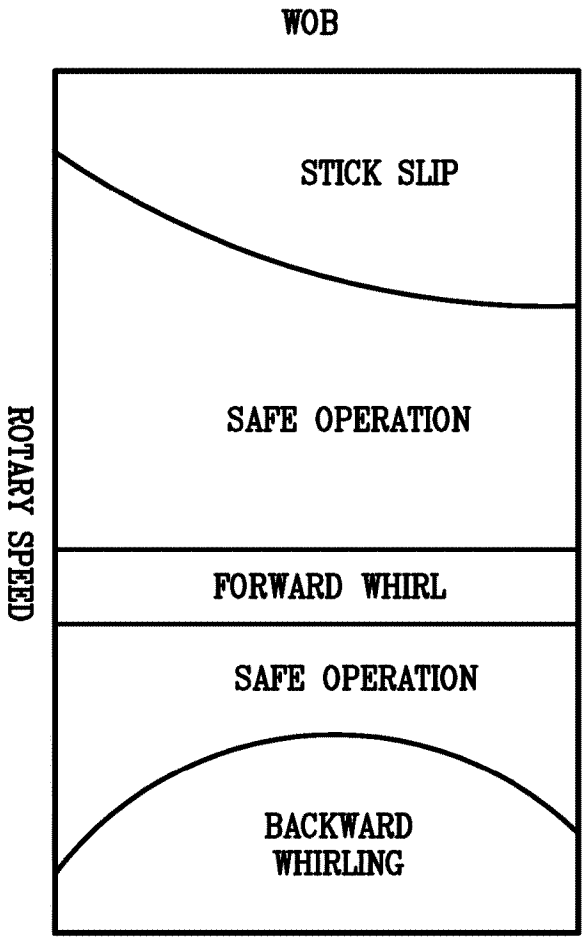
FIG. 9 is a computer generated display for an exemplary critical speed map generated according to the present disclosure.

The energy supplied ES and energy dissipated ED graphically represented as a displacement, or amplitude, as a function of input load is illustrated in FIG. 7. Assuming the energy supplied is equal to the energy dissipated, the software application can predict the amplitude (or displacement in the equations) of vibration at a given input load. Based on assumption that the energy is balanced, the software application uses the follow equation to predict amplitude of axial vibration:

$$Ym=(F_o \cdot \pi \cdot S_z)/(\delta \cdot w^2) \cdot H_{na}, \quad (3)$$

where

Ym is the maximum amplitude, or displacement (mm), for axial vibration,

Fo is total force (N),

Sz is an amplification factor defined is an indication of the proximity of an expected frequency to the natural frequency for a structure, such as drill string component, δ is displacement (mm), W is the angular velocity (rads/s), and Hna is the relative mode shape efficiency factor for axial vibration.

As can be seen from the above equations, the software application predicts vibration information based upon information indicating the relative mode shape efficiency (Hn) for axial, lateral and torsional vibration along the drill string. The mode shape efficiency is a measure of how much energy from the applied load goes into vibration. For example, the mode efficiency is highest for the first mode of a cantilevered beam with the load applied at the free end of the beam because the vibration is a maximum. Applying the load to the fixed end of the beam results in a mode efficiency factor of 0 since there is not any displacement at this location.

In step 290, the software application can also predict the amplitude of vibration taking into account bit whirling. Using the energy balance methodology discussed above, the software application uses the follow equation to predict amplitude for lateral vibration:

$$Yo=(Y_b \cdot \pi \cdot S_z)/(\delta \cdot w^2) \cdot H_{n1}, \quad (4)$$

where $Y_o$ is the maximum amplitude, or displacement (mm), for lateral vibration, $Y_b$ is displacement (mm), $S_z$ is the amplification factor as noted above, δ is displacement (mm), W is the angular velocity (rad/s), and $H_{n1}$ is the relative mode shape efficiency factor for lateral vibration, as noted above.

In step 290, the software application can also predict the amplitude of vibration taking into account bit moment. Using the energy balance methodology discussed above, the software application uses the follow equation to predict amplitude for torsional vibration:

$$\theta_m=(M_b \cdot \pi \cdot S_z)/(\delta \cdot w^2) \cdot H_{ni}, \quad (5)$$

where

θm is the maximum angular displacement (rad/s) for torsional vibration $M_b$ is the bending moment (N-m), $S_z$ is an amplification factor as noted above, δ is displacement (mm)

W is the angular velocity (rad/s),

Hn is the relative mode shape efficiency factor for lateral vibration as noted above, When, in step 290, the energy balance method has predicted the amplitude of vibration of axial, lateral and torsional vibration, in step 292, the software application can output the amplitude of vibration for a range of drill bit rotational speeds. Process control can be transferred to step 294. In step 294, the software application can determine the critical speeds of the drill string. The step of determining the critical speeds includes determining the critical speeds as a function of the loads applied on the drill string. It should be appreciated that the software application can associate the predicted vibration information with a range of critical speeds, a range of WOB, rotary speeds, flow rates and torque values for the drilling operation.

Figure 4:
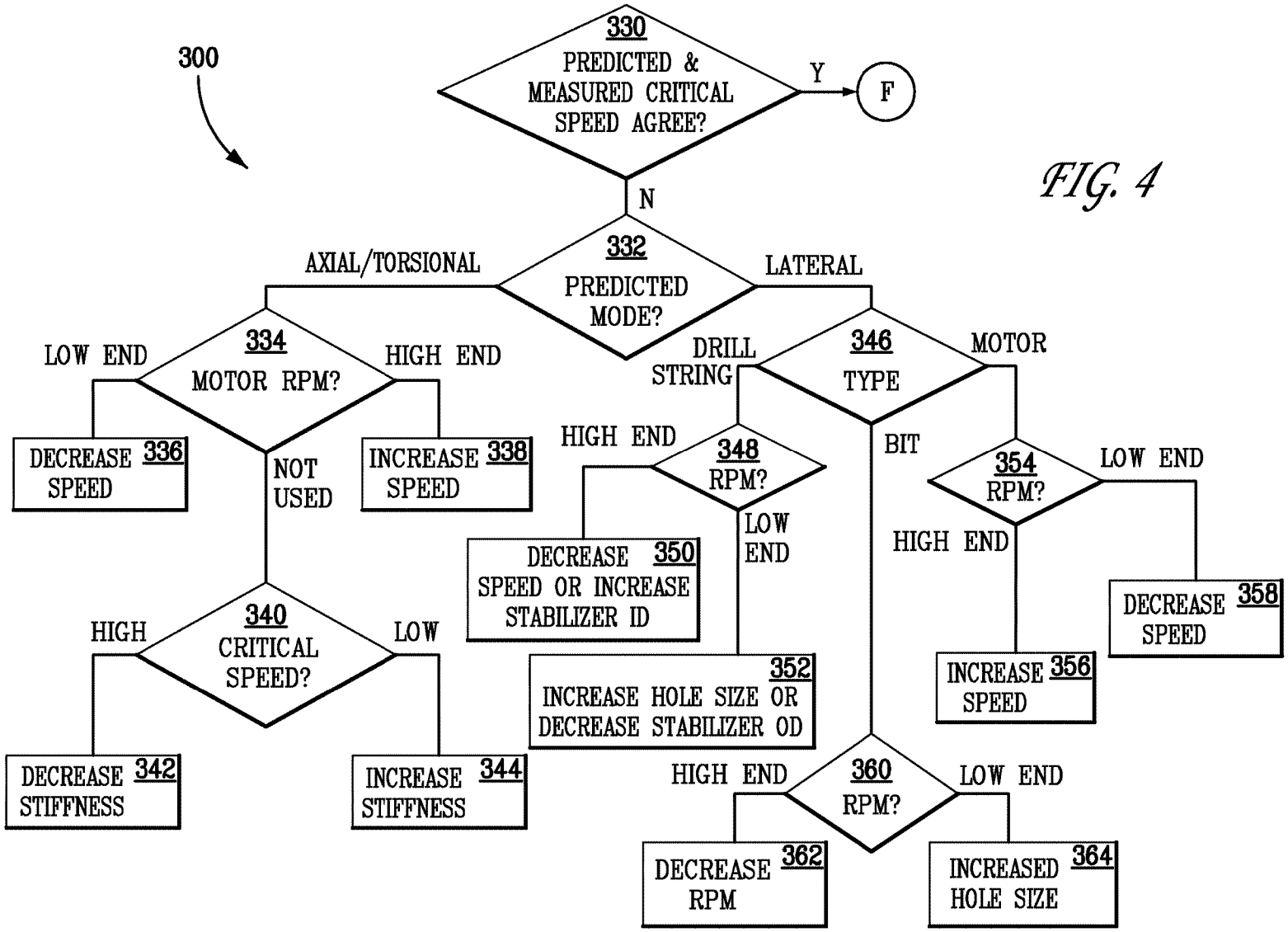
FIG. 4 is a block diagram illustrating a method for revising the drill system model based on the difference between the predicting vibration information and the measured vibration information.

According to another embodiment of the present disclosure, the software application is configured to update the drilling system model as needed. The software application develops a drilling system model by first defining the drill string and the borehole parameters that are not subject to change during drilling operation. The drill string and borehole parameter are stored in a computer memory of the computing device 200. As the drilling operation continues and certain drilling conditions change, the drill string and borehole parameters are modified and the analysis is re-run. For instance, the drilling parameters that change during drilling include drill bit rotational speed, WOB, inclination, depth, azimuth, mud weight, and borehole diameter. The software application, accesses and/or receive updating operation information based on real-time values of the drilling operating parameters based on the measurements of the surface and downhole sensors. For instance, the software application can access updated operating information stored in the memory portion of the computing device, and/or data acquisition system. Updated operating information can may be automatically measured and stored in memory, or alternatively, updated operating information may be obtain via separate systems and the data manually input in the computing device via the user interface, said data stored for access. Based on the updated operating parameters, the software application calculates the critical speeds for a range of operating conditions. The software application can also create a mode shape for the measured and predicted vibration information for each of an axial, lateral and torsional vibration. As shown in FIG. 4, the software application can cause the user interface to display the mode shapes at any given combination of RPM and WOB. In addition, the software application can cause the user interface to display the critical spends on a critical speed map. As shown in FIG. 5, the software application causes the display of drill bit rotational speed (RPM) on the x-axis and WOB on the y-axis.

Turning to FIG. 4, in accordance with another embodiment of the present disclosure, as indicated in connection with step 102 (method 70), the software application performs a vibration analysis in which it predicts (i) the natural frequencies of the drill string in axial, lateral and torsional modes and (ii) the critical speeds of the drill string, mud motor (if any), and critical speeds of the drill bit that excite these frequencies, as previously discussed. The software application can adjust the drilling system model if the actual critical speeds are have shifted from the predicted critical speeds such that drilling system model can correctly predict the critical speeds experienced by the drill string. As can be seen in FIG. 4, the software application can perform a method 300 that can adjust the drilling system model if the predicted critical speed at a drill bit rotational speed (RPM) during actual operation reveals the predicted critical speed does not result in resonant vibration. If a critical speed is encountered at drill bit rotation speed at which the drilling system model does not predict resonant vibration, then the drilling system model can be adjusted as well. It should be appreciated that the adjustment of critical speeds based an analysis of predicted vs. actual critical speeds can be completed after a successful elimination of high vibration that caused a loss of drilling performance, as discussed in above in connection with step 114.

Continuing with FIG. 4, the software application first determines in step 330 whether a predicted critical speed differs from a measured critical speed by more than a predetermined amount. If it does, in step 332, the software application determines whether the vibratory mode associated with the critical speed was related to the axial, lateral or torsional vibratory mode. If the critical speed was associated with the torsional or axial modes, then in step 334 the software application determines if the RPM at which the mud motor is thought to be operating, without encountering the predicted resonant vibration, is on the lower end of the predicted critical speed band. If it is, then in step 336 the motor RPM used by the model is decreased until the critical speed is no longer predicted. This accounts the motor having a different revolutions per gallon (RPG) than stated on the specification documentation for motor. Motor specification normally list the RPG at room temperature no load conditions. If it determines that the motor RPM is on the upper end of the predicted critical speed band, then in step 338 the motor RPM is increased until the critical speed is no longer predicted. If the mud motor is not being used, then in step 340 the software application determines whether the predicted critical speed is higher or lower than the speed at which the drill bit is operating. If it is higher, then in step 342 the drill string stiffness is decreased until the critical speed is no longer predicted. If it is lower, then in step 344, the drill string stiffness is increased until the critical speed is no longer predicted.

If the critical speed was associated with the lateral vibratory mode, then in step 346 the software application determines if the lateral vibration is due to drill bit, mud motor, or drill string lateral vibration. If the lateral vibratory mode is associated with the drill string, then in step 348 the software application determines whether the RPM at which the drill string is thought to be operating, without encountering resonance, is on the lower or higher end of the predicted critical speed band. If it is on the high end, then in step 350 the drill string speed used in the model is reduced or, if that is unsuccessful, a stabilizer OD is increased. If it is on the low end, then in step 352 borehole size used in the model is increased or, if that is unsuccessful, the OD of a stabilizer is decreased.

If the lateral vibratory mode is associated with the mud motor, then in step 354 the software application determines whether the RPM at which the mud motor is thought to be operating, without encountering resonant vibration, is on the lower or higher end of the predicted critical speed band. If it is on the high end, then in step 356 the mud motor speed used in the model is increased until the critical speed is no longer predicted. If it is on the low end, then in step 358 the mud motor speed used in the model is decreased until the critical speed is no longer predicted. If the lateral vibratory mode is associated with the drill bit, then in step 360 the software application determines whether the RPM at which the drill is thought to be operating is on the lower or higher end of the critical speed band. If it is on the high end, then in step 362 the drill bit speed is decreased until the critical speed is no longer predicted. If it is on the low end, then in step 364 the drill bit speed is increased until the critical speed is no longer predicted.

As noted above, the software application can predict vibration for a future drilling run, based on real-time information obtained during a current drill run. For instance, the software application can predict vibration information based on the current measured operating or real-time parameters. The software application can predict vibration, using the methodology discussed above, at each element along the drill string based on the real time values of: (i) WOB, (ii) drill bit RPM, (iii) mud motor RPM, (iv) diameter of borehole, (v) inclination, (vi) azimuth, (vii) build rate, and (viii) turn rate. For purposes of predicting vibration, WOB is preferably determined from surface measurements using the top drive sub 45, as previously discussed, although downhole strain gauges could also be used as previously discussed. Drill bit RPM is preferably determined by summing the drill string RPM and the mud motor RPM. The drill string RPM is preferably based on a surface measurement using the RPM sensor 32. The mud motor RPM is preferably based on the mud flow rate using a curve of mud motor flow rate versus motor RPM or an RPM/flow rate factor, as previously discussed. The diameter of the borehole is preferably determined from the backward whirl frequency using method described in U.S. Pat. No. 8,453,764 discussed above, although an assumed value could also be used, as also previously discussed. Inclination and azimuth are preferably determined from accelerometers 44 and magnetometers 42 in the bottomhole assembly 6, as previously discussed. Build rate is preferably determined based on the change in inclination. Turn rate is determined from the change in azimuth. Preferably, the information on WOB, drill string RPM and mud motor RPM is automatically sent to the processor 202. Information on inclination and azimuth, as well as data from the lateral vibration accelerometers (the backward whirl frequency if the Fourier analysis is performed downhole), are transmitted to the processor 202 by the mud pulse telemetry system or a wired pipe or other transmission system at regular intervals or when requested by the applications or when triggered by an event. Based on the foregoing, the software application calculates the frequency of the vibration at each point along the drill string (the amplitude having been determined previously), during the drilling operation. The software application, as noted above, can cause the user interface to display an image of the mode shape, as shown in FIG. 5, for the current operating condition, the vibratory mode shape of the drill string, which is essentially the relative amplitude of vibration along the drill string.

According to the present disclosure, three oscillating excitation forces are used to predict vibration levels: (i) an oscillating excitation force the value of which is the measured WOB and the frequency of which is equal to the speed of the drill bit multiplied by the number of blades/cones on the bit (this force is applied at the centerline of the bit and excites axial vibration), (ii) an oscillating force the value of which is the measured WOB and frequency of which is equal to the number of vanes (or blades) on drill bit times the drill bit speed (this force is applied at the outer diameter of the bit and creates a bending moment that excites lateral vibration), and (iii) an oscillating force the value of which is the calculated imbalance force based on the characteristics of the mud motor, as previously discussed, and the frequency of which is the frequency of which is equal to N (n+1), where N is the rotary speed of the rotor and n is the number of lobes on the rotor.

Vibration amplitude, or displacement in the above reference equations, is measured at the locations of vibration sensors, such as accelerometers. However, of importance to the operator is the vibration at the location of critical drill string components, such as an MWD tool. In step 104, the software application determines the ratio between the amplitude of vibration at a nearby sensor location and the amplitude of vibration at the critical component for each mode of vibration. The analysis in step 104 is based on predicted vibration mode shape and the known location of such critical drill string components as inputted in the model. Based on the inputted vibration limit for the component, the software application determines the vibration at the sensor that will result in the vibration at the component reaching its limit. The software application can cause the computing device to initiate a high vibration alarm if the vibration at the sensor reaches the correlated limit. For example, if the maximum vibration to which an MWD tool should be subjected is 5 g and the mode shape analysis indicates that, for lateral vibration, the ratio between the vibration amplitude at sensor #1 and the MWD tool is 1.5—that is, the amplitude of the vibration at the MWD tool is 1.5 times the amplitude at sensor #1, the software would advise the operator of the existence of high vibration at the MWD tool if the measured lateral vibration at sensor #1 exceeded 1.33 g. This extrapolation could be performed at a number of locations representing a number of critical drill string components, each with its own vibration limit. In addition to predicting vibration along the length of the drill at current operating conditions in order to extrapolate measured vibration amplitudes to other locations along the drill string, the software application can also predict vibration along the length of the drill string based on projected operating conditions. The software application can then determine whether a change in operating parameters, such as RPM or WOB, will affect vibration.

The software application can cause the user interface to display in a computer display a critical speed map as shown in FIG. 5 and further discussed below. As noted above, the critical speed may displays information indicating the combinations of WOB and drill string rotation speed should be avoided to avoid high axial or lateral vibration or stick slip. The software application can cause the user interface to display a critical speed map including information that indicates the combinations of WOB and mud motor rotation speed that should be avoided. The critical speed maps can be used as a guide for setting drilling parameters.

Turning to FIG. 5, in accordance with another embodiment of the present disclosure, the software application can determine that the difference between the predicted and measured vibration for any of the axial, lateral or torsional vibrations at sensor locations exceeds a predetermined threshold. In response, the software application revises the drilling system model by varying the operating parameter inputs used in the drilling system model, according to a predetermined hierarchy, until the difference is reduced below the predetermined threshold. Such an exemplary hierarchy is illustrated in the method 701 shown in FIG. 5. When the software application receives drilling data from the downhole sensors, the software application compares the measured level of vibration at the sensor locations to the predicted level of vibration at the same locations. Based on the analysis performed by the software application noted above, the drilling data system 12, computing device 200, and/or the database 230 can include store therein: (i) the measured axial, lateral and torsional vibration at the locations of the sensors downhole, (ii) the resonant frequencies for the axial, lateral and torsional vibration predicted by the software application, (iii) the mode shapes for the axial, lateral and torsional vibration based on real-time operating parameters predicted by the software application, and (iv) the levels of axial, lateral and torsional vibration at each point along the entire length of the drill string predicted by the software application. This information is used to determine how predicted and measured vibration information agrees.

Continuing with FIG. 5, a method 701 is used in which the hierarchy in parameters for which changes are attempted is preferably mud motor rotational speed, followed by WOB, followed by borehole size. In step 700, a determination is made whether the deviation between the measured and predicted vibration exceeds the predetermined threshold amount. If so, in steps 702 through 712, incremental increases and decreases in the mud motor rotational speed used in the drilling system model, within a prescribed permissible range of variation, are attempted until the deviation drops below the threshold amount. If no value of the mud motor rotational speed within the permissible range of variation results in the deviation in the vibration at issue dropping below the threshold amount, the software application revises the mud motor rotational speed used in the drilling system model to the value that reduced the deviation the most, but that did not cause the deviation between the predicted and measured values for another vibration to exceed the threshold amount.

If variation in mud motor rotational speed does not reduce the deviation below the threshold amount, in steps 714-724, the WOB used in the drilling system model is then decreased and increased, within a prescribed permissible range of variation, until the deviation drops below the threshold amount. If no value of WOB within the permissible range of variation results in the deviation between the measured and predicted vibration dropping below the threshold amount, the software application revises the WOB used in the model to the value that reduced the deviation the most, but that did not cause the deviation between the predicted and measured values for another vibration to exceed the threshold amount.

If variation in WOB does not reduce the deviation below the threshold amount, in steps 726-736, the assumed borehole size used in the model is then decreased and increased within a prescribed permissible range of variation—which range may take into account whether severe washout conditions were expected, in which case the diameter could be double the predicted size—until deviation drops below the threshold amount. If a value of borehole size results in the deviation dropping below the threshold amount, without causing the deviation in another vibration to exceed the threshold amount, then the model is revised to reflect the new borehole size value. If no value of borehole size within the permissible range of variation results in the deviation between the measured and predicted vibration dropping below the threshold amount, the software revises the borehole size used in the model to the value that reduced the deviation the most, but that did not cause the deviation in another vibration level to exceed the threshold amount. Alternatively, rather than using the sequential single variable approach discussed above, the software application could be programmed to perform multi-variable minimization using, for example, a Taguichi method. Further, if none of the variations in mud motor RPM, WOB and borehole diameter, separately or in combination, reduces the deviation below the threshold, further investigation would be required to determine whether one or more of the inputs were invalid, or whether there was a problem down hole, such as a worn bit, junk (such as bit inserts) in the hole, or a chunked out motor (rubber breaking down).

It should be appreciated that other hierarchies can be used to revise the drilling system model. For instance, if the step of comparing the predicted versus measured vibration is performed by the software application following a successful mitigation of high vibration (for instance step 114 in FIG. 3A) as described in U.S. Pat. No. 8,453,764, which is incorporated by reference herein, the results of the mitigation are used to guide the revision of the drilling system model used to predict the vibration. As will be appreciated by one skill in the art, the method of mitigating lost performance due to high vibration cannot be employed if the attempted mitigation was unsuccessful or if mitigation was unnecessary.

Figure 6:
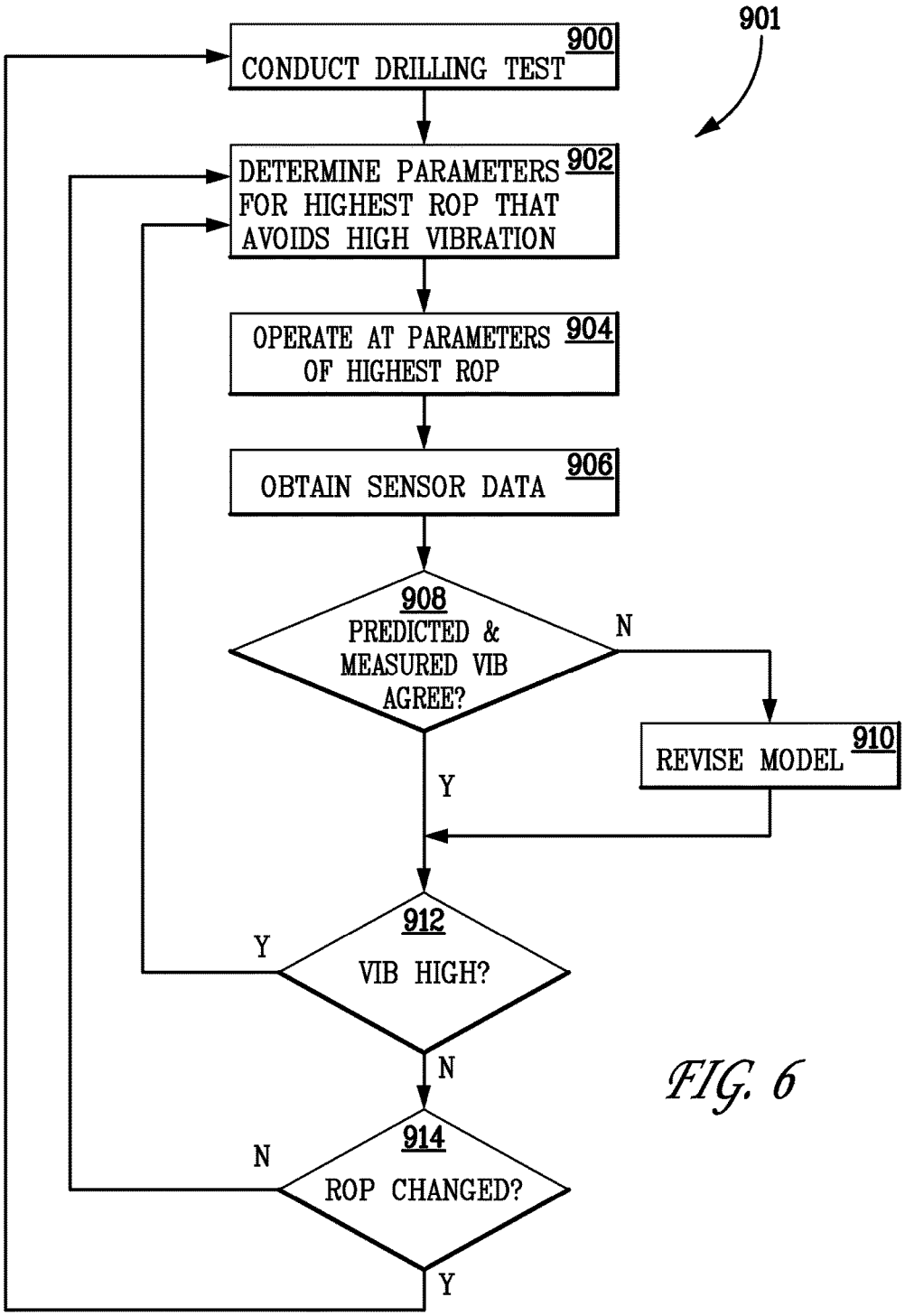
FIG. 6 is a block diagram illustrating a method for operating a drilling system shown in FIG. 1 in order to attain a desired rate of penetration and avoid excessive vibration.

Referring now to FIG. 6, according to yet another embodiment of the present disclosure, the software application automatically determines if the optimum drilling performance is being achieved and makes recommendations if optimum drilling performance is not being achieved. In general, the higher the drill bit RPM and the greater the WOB, the higher the rate of penetration by the drill bit into the formation, resulting in more rapid drilling. However, increasing drill bit RPM and WOB can increase vibration, which can reduce the useful life of the bottomhole assembly components. A method 901 for optimizing drilling efficiency includes the initial step 900 of performing one or more drilling tests are performed so as to obtain a database of ROP versus WOB and drill string and drill bit RPM. In addition, in step 900, the drilling test can be begin with a pre-run analysis of the drilling operation using the software application. The pre-run analysis can be used to design a bottomhole assembly that will drill the planned well, have sufficient strength for the planned well and to predict critical speeds to avoid during the drilling operation. During the pre-analysis process components of the drill string can be moved or altered to achieve the desired performance. Modifications may include adding, subtracting or moving stabilizers, selecting bits based on vibration excitation and performance and specifying mud motors power sections, bend position and bend angle. Based on the analysis the initial drilling component information and drilling operation parameters are set.

In step 902, the software application can determine a set of drilling parameters that can optimize ROP without producing excessive vibration, based in part on the drilling performance results and predicted vibration levels conducted during the drilling tests. Alternatively, the software application can generate graphical display illustrating predicted axial vibration versus WOB and the measured rate of penetration versus WOB. Using these graphical displays, the operator can select the WOB that will result in the maximum rate of penetration without incurring excessive axial vibration. Similar graphs would be generated for other modes of vibration. In addition, during step 902, the software application determines the critical speeds of the drill string and then determines whether operation at the WOB and drill string/drill bit rotation speeds that yielded the highest ROP based on the drilling test data will result in operation at a critical speed. Alternatively, the software application can predict the level of vibration at the critical components in the drill string at the WOB and drill string/drill bit RPMs that yielded the highest ROP to determine whether operation at such conditions will result in excessive vibration of the critical components. In any event, if the software application predicts vibration problems at the operating conditions that resulted in the highest ROP, it will then check for high vibration at the other operating conditions for which data was obtained in the drilling tests until it determines the operating conditions that will result in the highest ROP without encountering high vibration. The software application will then recommend to the operator that the drill string be operated at the WOB and drill string/drill bit rotation speeds that are expected to yield the highest ROP without encountering excessive vibration. The drilling operation will continue at the determined set of drilling parameters that optimized ROP.

In step 904, the drilling operation will continue at the set operating at the parameters recommended by the software application. The drilling operation would continue until there was a change to the drilling conditions. Changes may include bit wear, different formation type, changes in inclination, azimuth, depth, vibration increase, etc. In step 906, the software application will periodically access drilling data from the downhole and surface sensors, as discussed above.

In step 908, the software application will determine whether the measured and predicted vibration information agree. If the software application determines in step 908 that the measured and predicted vibration information do not agree, or match, process control is transferred to step 910 and the drilling system model will be revised. If software application determine in step 908 that the measured and predicted vibration information agree, process control is transferred to step 912. Thus, the optimization of drilling parameters will be performed using an updated drilling system model that predicts vibration based on real-time data from the sensors downhole.

In step 912, the software application determines whether, based on drilling data from the sensors downhole, the vibration in the drill string is high, for example, by determining whether the drill string operation is approaching a new critical speed or whether the vibration at a critical component exceeds the maximum for such component. If the software application determine that vibration is high, then process control is transferred to step 902, and the steps 902 to 910 are repeated and the software application determines another set of operating parameters that will result in the highest expected ROP without encountering excessive vibration. If, in step 912, the software application determines that vibration data is low, process control is transferred to block 914.

Based on data from the ROP sensor 34, in step 914, the software application determines whether the ROP has deviated from that expected based on the drilling test. If it has, the software application may recommend that further drilling tests be performed to create a new data base of ROP versus WOB and drill string/drill bit RPM.

For purposes of illustration the optimization method 901 discussed above, assume a drilling test produced the following ROP data (for simplicity, assume no mud motor so that the drill bit RPM is the same as the drill string RPM):

TABLE I

| WOB, lbs | 200 RPM | 300 RPM |
|---|---|---|
| 10k | 10 fpm | 20 fpm |
| 20k | 15 fpm | 25 fpm |
| 30k | 20 fpm | 30 fpm |
| 40k | 25 fpm | 33 fpm |

The software application can predict if operating the drill string at 40 k WOB and 300 RPM (the highest ROP point in the test data) will result in the drilling system operating at a critical speed or in excessive vibration at a critical component. If the process determines that operating the drill string at 40 k WOB and 300 RPM (the highest ROP point in the test data) does not result in a critical speed or excessive vibration, the software application can cause the computer system to display to the user a recommendation to operate at 40 k WOB and 300 RPM. Thereafter, each time a new set drilling data is obtained (or a new section of drill pipe added), the software application will (i) revise the drilling system model if the predicted vibration at the respective location of the sensors does not agree with the measured vibration, and (ii) determine whether the vibration is excessive. The software application can determine if the vibration is excessive using the revised drilling system model to determine the vibration at the critical components by extrapolating the measured vibration.

If, at some point, the process determines that vibration of the drill string has become excessive, the process predicts that the vibration at 30 k WOB and 300 RPM (the second highest ROP point from the drilling test data) and recommends that the operator go to those operating conditions unless it predicted excessive vibration at those conditions. Thereafter, each time another set of drilling data was obtained (and the model potentially revised), the software application will predict whether it was safe to again return to the initial operating conditions associated with the highest ROP (40 k WOB/300 RPM) without encountering excessive vibration. If the software never predicts that it is safe to go back to the initial operating conditions but, at some point, it determines that the vibration has again become excessive, it will predict vibration at the two sets of parameters that resulted in the third highest ROP—20 k WOB/300 RPM and 40 k WOB/200 RPM—and recommend whichever one resulted in the lower predicted vibration.

In some embodiments, instead of merely recommending changes that the operator makes to the operating parameters, the method automatically adjusts the operating parameters so as to automatically operate at the conditions that resulted in maximum drilling performance.

According to another embodiment of the present disclosure, rather than using ROP as the basis for optimization, the software can use the Mechanical Specific Energy ("MSE") to predict the effectiveness of the drilling, rather than the ROP. The MSE can be calculated, for example, as described in F. Dupriest & W. Koederitz, "Maximizing Drill Rates With Real-Time Surveillance of Mechanical Specific Energy," SPE/IADC Drilling Conference, SPE/IADC 92194 (2005) and W. Koederitz & J. Weis, "A Real-Time Implementation Of MSE," American Association of Drilling Engineers, AADE-05-NTCE-66 (2005), each of which is hereby incorporated by reference in its entirety. For purposes of calculating MSE, the software obtains the value of ROP from one or more drilling tests, as described above, as well as the torque measured during each drilling test. Based on these calculations, the process can generate a recommendation to the user/operator that the drill bit rotation speed and WOB to revise values that yielded the highest MSE value.

Although the invention has been described with reference to specific methodologies for monitoring vibration in a drill string, the invention is applicable to the monitoring of vibration using other methodologies based on the teachings herein. For example, although the invention has been illustrated using mud motor rotary drilling it can also be applied to pure rotary drilling, steerable systems, rotary steerable systems, high pressure jet drilling, and self propelled drilling systems, as well as drills driven by electric motors and air motors. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. A method for monitoring and controlling a drilling system that includes a drill string and a drill bit supported at a downhole end of the drill string, the drilling system configured to form a borehole in an earthen formation, the method comprising the steps of:

predicting, via a drilling system model, vibration information for the drill string based on a set of drilling operating parameters and drilling system component information, the set of drilling operating parameters including a weight-on-bit (WOB) and a drill bit rotational speed and the drilling system component information including one or more characteristics of the drill string and the drill bit, the predicted vibration information including an amplitude for at least one of an axial vibration, lateral vibration, and a torsional vibration of the drill string, wherein the drilling system model predicts vibration information based on an energy balance of the drill string operating according to the set of drilling operating parameters during an expected drilling operation, wherein the energy balance is a balance of an energy supplied to the drilling system with an energy dissipated from the drilling system, wherein the energy supplied is the product of at least the distributed force, a function of the phase angle, and a function of the displacement along the drill string, and the energy dissipated is the product of at least the spring rate, damping coefficient, and displacement of the drill string components, as a function of forces applied to the drill string;

operating the drilling system to drill the borehole in the earthen formation according to the set of drilling operating parameters;

measuring in the borehole during the drilling operation at least one of the axial vibration, lateral vibration, and a torsional vibration of the drill string; and comparing the predicted vibration information for the drill string and the drill bit to the measured vibration information for the drill string and the drill bit, and if the step of comparing results in a difference between the expected and measured vibration information for each of the drill string and the drill bit, updating the drilling system model to reduce the difference between the expected and measured vibration information for the drill string and the drill bit.

2. The method of claim 1, wherein predicting vibration information is based upon information indicating a relative mode shape efficiency for each one of the axial vibration, the lateral vibration, and the torsional vibration.

3. The method of claim 1, wherein the step of predicting vibration information is based on a frequency domain type of finite element model by applying the energy balance to the drill string as a function of one or more forces applied to the drill string.

4. The method of claim 1, further comprising the step of accessing the set of drilling operating parameters for a drilling operation, the set of drilling operating parameters selected so as to attain an expected maximum rate-of-penetration through the earthen formation.

5. The method of claim 4, further comprising the step of accessing borehole information, wherein the borehole information includes a borehole diameter.

6. The method of claim 4, wherein the step of accessing the set of drilling operating parameters further comprises receiving the set of drilling operating parameters.

7. The method of claim 6, wherein the step of accessing borehole information further comprises receiving borehole information.

8. The method of claim 1, based on an adjustment to one or more of the set of drilling operating parameters, further predicting via the updated drilling system model the vibration information for the drill string and the drill bit based on the adjusted set of drilling operating parameters, the borehole information, and the drilling system component information.

9. The method of claim 1, wherein the drilling operation includes one or more drill runs of the drill string to form the borehole in the earthen formation.

10. The method of claim 1, further comprising the step of determining critical speeds for the drill string based on the set of operating parameters and the vibration information of the drill string and drill bit.

11. A drilling system configured to form a borehole in an earthen formation during a drilling operation, the drilling system comprising:

a drill string supporting a drill bit, the drill bit configured to define the borehole;

a plurality of sensors configured to obtain drilling operation information and measured vibration information, wherein one or more of the plurality of sensors are configured to measure in the borehole during the drilling operation, at least one of an axial vibration, lateral vibration, and a torsional vibration of the drill string so as to obtain the measured vibration information;

at least one computing device including a memory portion having stored thereon drilling system component information, the drilling system component information including one or more characteristics of the drill string, the memory portion further including expected operating information for the drilling operation, the expected operating information including at least a weight-on-bit (WOB), a rotational speed of the drill bit, a borehole diameter, and a vibration damping coefficient; and a computer processor in communication with the memory portion, the computer processor configured to predict vibration information for the drill string, the predicted vibration information including at least a predicted amplitude for at least one of the axial vibration, the lateral vibration, and the torsional vibration of the drill string, the predicted vibration information being based on the drilling system component information and an energy balance of the drill string operating according to the expected operation information for the drilling operation, wherein the energy balance includes a balance of an energy supplied to the drilling system with an energy dissipated from the drilling system, wherein the energy supplied is the product of at least the distributed force, a function of the phase angle, and a function of the displacement along the drill string, and the energy dissipated is the product of at least the spring rate, damping coefficient, and displacement of the drill string components, as a function of forces applied to the drill string, the computing processor being further configured to compare the predicted vibration information for the drill string and the drill bit to the measured vibration information for the drill string and the drill bit, wherein the computing device is configured to update the drilling system model if a difference between the expected and measured vibration information is detected.

12. The drilling system of claim 11, wherein the predicted vibration information is based upon information indicating a relative mode shape efficiency for each one of the axial vibration, the lateral vibration, and the torsional vibration.

13. The drilling system of claim 11, wherein the predicted vibration information is based on a frequency domain type of finite element model that applies the energy balance to the drill string as a function of one or more forces applied to the drill string.

14. The drilling system of claim 11, wherein the predicted vibration is the mode shape for at least one of axial, lateral and torsional vibration along the drill string.

15. The drilling system of claim 11, wherein the one or more characteristics of the drill string include a drill string geometry, material properties of the drill string, location and number of stabilizers on the drill string, inclination of the drill string, and drill bit geometry.

16. The drilling system of claim 11, further comprising a communications system configured to transmit data obtained downhole during the drilling operation to the at least one computing device.

17. The drilling system of claim 16, wherein the communications system is pulse telemetry system.

18. The drilling system of claim 16, wherein the communications system is a wired system.

19. The drilling system of claim 11, wherein the drill string supports a bottomhole assembly at a downhole end of the drill string, and the drill bit is coupled to the bottomhole assembly, wherein the plurality of sensors includes a first set of sensors carried by the bottomhole assembly, a second set of sensors disposed along the drill string, and a third set of sensors disposed on a surface structure of the drilling system.

* * * * *